US010449594B2

(12) United States Patent
Hibbs et al.

(10) Patent No.: US 10,449,594 B2
(45) Date of Patent: Oct. 22, 2019

(54) FLANGE PROJECTION CONTROL SYSTEM AND METHOD

(71) Applicant: EKL Machine Company, Andalusia, PA (US)

(72) Inventors: William Hibbs, Bolivar, OH (US); Daniel Livezey, Feasterville, PA (US); Jeffrey Schenk, Bensalem, PA (US); Daniel Menno, Norristown, PA (US); Edward Lydon, Bensalem, PA (US)

(73) Assignee: EKL Machine Company, Andalusia, PA (US)

( * ) Notice: Subject to any disclaimer, the term of this patent is extended or adjusted under 35 U.S.C. 154(b) by 830 days.

(21) Appl. No.: 14/939,425

(22) Filed: Nov. 12, 2015

(65) Prior Publication Data

US 2016/0129494 A1 May 12, 2016

Related U.S. Application Data

(60) Provisional application No. 62/078,597, filed on Nov. 12, 2014.

(51) Int. Cl.
*B21D 51/26* (2006.01)
*B21D 24/00* (2006.01)
(Continued)

(52) U.S. Cl.
CPC ..... *B21D 51/26* (2013.01); *B21D 22/20* (2013.01); *B21D 24/005* (2013.01); *B21D 28/08* (2013.01)

(58) Field of Classification Search
CPC ..... B21D 22/24; B21D 22/28; B21D 24/005; B21D 51/26
See application file for complete search history.

(56) References Cited

U.S. PATENT DOCUMENTS 4,711,611 A * 12/1987 Bachmann ..... B21D 51/26 413/69
5,098,751 A * 3/1992 Tamura ..... B32B 15/08 428/35.8

(Continued)

FOREIGN PATENT DOCUMENTS

DE 102011077328 A1 * 10/2012 ..... B21D 22/22

OTHER PUBLICATIONS

Machine Translation of DE-102011077328, Translated Feb. 12, 2019, 8 Pages. (Year: 2012).*

(Continued)

*Primary Examiner* — Gregory D Swiatocha
(74) *Attorney, Agent, or Firm* — Pepper Hamilton LLP

(57) ABSTRACT

Embodiments provide a tooling station for forming containers that includes a blank and draw punch configured to blank off a portion of stock from a stock element and draw the portion of stock to form a cup. The blank and draw punch includes a blank and draw punch curved edge disposed between a blank and draw punch inner circumferential wall and a blank and draw punch proximal surface. The blank and draw punch curved edge has a radius of curvature that varies along its circumference. The tooling station also includes a draw-redraw die configured to redraw the cup to form a can having a flange. The draw redraw die includes a draw-redraw die curved edge disposed between a draw-redraw die inner circumferential wall and a draw-redraw die proximal surface. The draw-redraw die curved edge has a radius of curvature that varies along its circumference.

11 Claims, 23 Drawing Sheets

(51) Int. Cl.
*B21D 22/20* (2006.01)
*B21D 28/08* (2006.01)

(56) References Cited

U.S. PATENT DOCUMENTS 5,261,261 A 11/1993 Ramsey
5,413,244 A 5/1995 Ramsey
5,626,049 A 5/1997 Saunders
5,630,337 A * 5/1997 Werth ..... B21D 22/28 72/349
5,645,190 A 7/1997 Goldberg
5,750,222 A 5/1998 Komatsu et al.
5,802,907 A * 9/1998 Stodd ..... B21D 22/28 72/336
5,899,104 A 5/1999 Brilman et al.
5,899,355 A 5/1999 Claydon et al.
5,946,964 A 9/1999 Snyder et al.
5,960,659 A 10/1999 Hartman et al.
5,970,767 A 10/1999 Hartman et al.
5,987,951 A * 11/1999 Saunders ..... B21D 22/201 72/349
6,126,034 A 10/2000 Borden et al.
6,220,073 B1 4/2001 Cheng et al.
6,374,657 B1 4/2002 Kirk et al.
6,442,991 B1 9/2002 Rojek
6,460,723 B2 10/2002 Nguyen et al.
7,185,525 B2 3/2007 Werth et al.
7,845,204 B2 12/2010 Smyers et al.
8,328,492 B2 12/2012 Turner et al.
8,341,995 B2 1/2013 Turner
2013/0059166 A1 3/2013 Nagata et al.
2013/0098927 A1 4/2013 Monro et al.
2015/0246384 A1* 9/2015 Ikeda ..... B21D 22/22 72/347

OTHER PUBLICATIONS

PCT/US2015/060347 International Search Report dated Jan. 28, 2016.

* cited by examiner

Conventional Tooling

| Can Type / Test | Filter name | % in Spec | Lower Spec | Upper Spec | Total subgroups | Mean | Minimum value | Maximum value | SD (sample) | Mean - 3SD | Mean + 3SD |
|---|---|---|---|---|---|---|---|---|---|---|---|
| CAN COUNTERSINK | CONTROL | NA | NONE | NONE | 6 | 0.15489 | 0.15260 | 0.15720 | 0.00108 | 0.15165 | 0.15813 |
| CAN 05 SEAM HEIGHT | CONTROL | NA | NONE | NONE | 6 | 0.11386 | 0.10800 | 0.11720 | 0.00215 | 0.10750 | 0.12043 |
| CAN SEAM THICKNESS | CONTROL | NA | NONE | NONE | 6 | 0.04996 | 0.04890 | 0.05120 | 0.00095 | 0.04682 | 0.05193 |
| CAN 07 COVER HOOK | CONTROL | NA | NONE | NONE | 6 | 0.07537 | 0.07020 | 0.07990 | 0.00103 | 0.06959 | 0.08116 |
| CAN 06 BODY HOOK | CONTROL | NA | NONE | NONE | 6 | 0.07587 | 0.07040 | 0.08120 | 0.00397 | 0.06875 | 0.08459 |
| CAN 09 OVERLAP | CONTROL | NA | NONE | NONE | 6 | 0.04806 | 0.04150 | 0.05450 | 0.00383 | 0.03855 | 0.05856 |
| CAN WRINKLE | CONTROL | 100.00% | 75.0 | NONE | 6 | 100.0 | 100.0 | 100.0 | 0.0 | 100.0 | 100.0 |
| CAN PLATE THICKNESS | CONTROL | NA | NONE | NONE | 2 | 0.00850 | 0.00850 | 0.00850 | 0.00000 | 0.00850 | 0.00850 |
| D34158404 CAN HEIGHT UNFI | CONTROL | NA | NONE | NONE | 5 | 1.5846 | 1.5815 | 1.5870 | 0.0021 | 1.5810 | 1.5872 |
| D34158404 MAX FLANGE UNFI | CONTROL | NA | NONE | NONE | 5 | 0.3253 | 0.3091 | 0.3371 | 0.0129 | 0.2946 | 0.3528 |
| D34158404 MIN FLANGE UNFI | CONTROL | NA | NONE | NONE | 5 | 0.2497 | 0.2331 | 0.2782 | 0.0206 | 0.1979 | 0.3016 |
| D34158404 PANEL | CONTROL | 100.00% | 17.50 | NONE | 3 | 31.48 | 31.48 | 31.48 | 0.00 | 31.48 | 31.48 |
| D34158404 BUCKLE | CONTROL | 100.00% | 15.50 | NONE | 3 | 18.00 | 17.90 | 18.10 | 0.10 | 17.70 | 18.30 |
| D34158404 AXIAL LOAD | CONTROL | 100.00% | 460.0 | NONE | 5 | 504.8 | 502.0 | 508.0 | 2.2 | 498.3 | 511.3 |

1301

1302

Exemplary Die

| Can Type / Test | Filter name | % in Spec | Lower Spec | Upper Spec | Total subgroups | Mean | Minimum value | Maximum value | SD (sample) | Mean - 3SD | Mean + 3SD |
|---|---|---|---|---|---|---|---|---|---|---|---|
| CAN COUNTERSINK | LANE 6 | NA | NONE | NONE | 6 | 0.15623 | 0.15460 | 0.15750 | 0.00085 | 0.15367 | 0.15880 |
| CAN 05 SEAM HEIGHT | LANE 6 | NA | NONE | NONE | 6 | 0.11437 | 0.11160 | 0.11750 | 0.00151 | 0.10994 | 0.11900 |
| CAN SEAM THICKNESS | LANE 6 | NA | NONE | NONE | 6 | 0.05042 | 0.04920 | 0.05200 | 0.00075 | 0.04818 | 0.05266 |
| CAN 07 COVER HOOK | LANE 6 | NA | NONE | NONE | 6 | 0.07481 | 0.07200 | 0.07940 | 0.00196 | 0.06835 | 0.08075 |
| CAN 06 BODY HOOK | LANE 6 | NA | NONE | NONE | 6 | 0.07723 | 0.07440 | 0.08000 | 0.00130 | 0.07274 | 0.08171 |
| CAN 09 OVERLAP | LANE 6 | NA | NONE | NONE | 6 | 0.04844 | 0.04420 | 0.05230 | 0.00214 | 0.04203 | 0.05485 |
| CAN WRINKLE | LANE 6 | 100.00% | 75.0 | NONE | 6 | 100.0 | 100.0 | 100.0 | 0.0 | 100.0 | 100.0 |
| CAN PLATE THICKNESS | LANE 6 | NA | NONE | NONE | 7 | 0.00850 | 0.00850 | 0.00850 | 0.00000 | 0.00850 | 0.00850 |
| D34158404 CAN HEIGHT UNFI | LANE 6 | NA | NONE | NONE | 5 | 1.5872 | 1.5865 | 1.5885 | 0.0006 | 1.5854 | 1.5889 |
| D34158404 MAX FLANGE UNFI | LANE 6 | NA | NONE | NONE | 5 | 0.3364 | 0.3344 | 0.3401 | 0.0023 | 0.3314 | 0.3464 |
| D34158404 MIN FLANGE UNFI | LANE 6 | NA | NONE | NONE | 5 | 0.2748 | 0.2739 | 0.2778 | 0.0017 | 0.2697 | 0.2799 |
| D34158404 PANEL | LANE 6 | 100.00% | 17.50 | NONE | 3 | 30.79 | 30.45 | 31.48 | 0.59 | 29.01 | 32.58 |
| D34158404 BUCKLE | LANE 6 | 100.00% | 15.50 | NONE | 3 | 17.03 | 16.40 | 17.40 | 0.55 | 15.38 | 18.69 |
| D34158404 AXIAL LOAD | LANE 6 | 100.00% | 460.0 | NONE | 5 | 488.6 | 485.0 | 492.0 | 2.4 | 481.4 | 495.8 |

1303

1304

FIG. 13

FLANGE PROJECTION CONTROL SYSTEM AND METHOD

CROSS-REFERENCE TO RELATED APPLICATIONS

This application claims the benefit of U.S. Provisional Application No. 62/078,597, filed on Nov. 12, 2014, which is incorporated herein in its entirety.

TECHNOLOGY FIELD

The present application relates generally to a system and method for manufacturing metal containers, and in particular, to a system and method for controlling the flange projection of the metal containers during the manufacturing of the metal containers.

BACKGROUND

Container manufacturing (e.g., cans) includes drawing stock using different tools. Stock may include any metal material such as aluminum, steel, and metal alloys. For example, some conventional container manufacturing methods include a draw-redraw (DR) process to produce a can. In this method, a blank and draw punch is first used to create a metal cup by blanking off a portion of stock from a coil and drawing the metal between two pieces of tooling (e.g., the blank and draw punch and a draw-redraw die). The cup forms across the tangent points of the inner radiuses of the blank and draw punch. The draw-redraw die is then used to redraw the cup across the tangent points of the inner radiuses of the draw-redraw die to form a can having a flange. After the flange is formed, portions of the outer circumference of the flange may be trimmed off to produce an even (substantially round) flange edge. Other conventional container manufacturing methods include a drawn and ironed (D&I) process to produce a cup. In this method a blank and draw punch is used to create a metal cup by blanking off a portion of stock from a coil and drawing the metal between two pieces of tooling (e.g., the blank and draw die and a cup punch). The cup forms across the tangent points of the inner radiuses of the blank and draw punch. The cup is discharged from the machine and transferred to downstream equipment. The cup may then be provided to other machinery (e.g., a body maker) which elongates the cup body to produce a can.

In one conventional method, the blank and draw punch and the draw-redraw die are part of a single machine and the cup and can are formed in a single stroke process. In another conventional method, the blank and draw punch and the draw-redraw die are separate and the cup and can are formed separately in a two-step process. Although metal drawing and metal redrawing systems and methods exist, there is a continuing need for different and improved metal drawing and metal redrawing systems and methods.

SUMMARY

Embodiments provide a tooling station for forming containers that includes a blank and draw punch configured to blank off a portion of stock from a stock element and draw the portion of stock to form a cup. The blank and draw punch includes a blank and draw punch inner circumferential wall defining a blank and draw punch cavity, a blank and draw punch proximal surface extending substantially perpendicular to the blank and draw punch inner circumferential wall and a blank and draw punch curved edge disposed between the blank and draw punch inner circumferential wall and the blank and draw punch proximal surface. The blank and draw punch curved edge has a radius of curvature that varies along its circumference. The tooling station also includes a draw-redraw die configured to redraw the cup to form a can having a flange. The draw redraw die includes a draw-redraw die inner circumferential wall defining a draw-redraw die cavity, a draw-redraw die proximal surface extending substantially perpendicular to the draw-redraw die inner circumferential wall and a draw-redraw die curved edge disposed between the draw-redraw die inner circumferential wall and the draw-redraw die proximal surface. The draw-redraw die curved edge has a radius of curvature that varies along its circumference.

According to one embodiment, the blank and draw punch is configured to form the cup by drawing the portion of stock across tangent points of the varied radius of curvature of the blank and draw punch curved edge.

According to another embodiment, the draw-redraw die is configured to form the can having the flange by redrawing the formed cup across tangent points of the varied radius of curvature of the draw-redraw die curved edge.

According to an aspect of an embodiment, the varied radius of curvature of the blank and draw punch curved edge is further configured to control a variance of a height of a top edge of the cup and the varied radius of curvature of the draw-redraw die curved edge is further configured to control a variance of a flange width or cup height.

Embodiments provide a blank and draw punch for forming cups that includes a blank and draw punch base; and a blank and draw punch cylindrical portion extending from the blank and draw punch base. The blank and draw punch cylindrical portion includes a blank and draw punch inner circumferential wall defining a blank and draw punch cavity, a blank and draw punch proximal surface extending substantially perpendicular to the blank and draw punch inner circumferential wall and a blank and draw punch curved edge disposed between the blank and draw punch inner circumferential wall and the blank and draw punch proximal surface, the blank and draw punch curved edge having a radius of curvature that varies along its circumference.

According to one embodiment, the blank and draw punch is configured to form a cup by drawing the portion of stock across tangent points of the varied radius of curvature of the blank and draw punch curved edge.

According to another embodiment, the varied radius of curvature of the blank and draw punch curved edge is further configured to control a variance of a height of a top edge of the cup.

Embodiments provide a draw-redraw die configured to redraw a cup to form a can. The draw-redraw die includes a draw-redraw die base and a draw-redraw die cylindrical portion extending from the draw-redraw die base. The draw-redraw die cylindrical portion includes a draw-redraw die inner circumferential wall defining a draw-redraw die cavity a draw-redraw die proximal surface extending substantially perpendicular to the draw-redraw die inner circumferential wall and a draw-redraw die curved edge disposed between the draw-redraw die inner circumferential wall and the draw-redraw die proximal surface. The draw-redraw die curved edge has a radius of curvature that varies along its circumference.

According to one embodiment, the draw-redraw die is configured to form the can by redrawing the formed cup across tangent points of the varied radius of curvature of the draw-redraw die curved edge.

Embodiments provide a die assembly for forming containers. The die assembly has a plurality of tooling stations. Each tooling station includes (i) a blank and draw punch configured to blank off a portion of stock from a stock element and draw the portion of stock to form a cup; and (ii) a draw-redraw die configured to redraw the cup to form a can having a flange. The blank and draw punch includes a blank and draw punch inner circumferential wall defining a blank and draw punch cavity, a blank and draw punch proximal surface extending substantially perpendicular to the blank and draw punch inner circumferential wall and a blank and draw punch curved edge disposed between the blank and draw punch inner circumferential wall and the blank and draw punch proximal surface, the blank and draw punch curved edge having a radius of curvature that varies along its circumference. The draw-redraw die includes a draw-redraw die inner circumferential wall defining a draw-redraw die cavity, a draw-redraw die proximal surface extending substantially perpendicular to the draw-redraw die inner circumferential wall and a draw-redraw die curved edge disposed between the draw redraw die inner circumferential wall and the draw-redraw die proximal surface. The draw-redraw die curved edge has a radius of curvature that varies along its circumference.

Embodiments provide a method of forming containers that includes receiving a stock element at a tooling station having a blank and draw punch comprising a blank and draw punch curved edge disposed between a blank and draw punch inner circumferential wall and a blank and draw punch proximal surface. The blank and draw punch curved edge has a radius of curvature that varies along its circumference. The method also includes blanking off a portion of stock from the stock element using the blank and draw punch and forming, via the blank and draw punch, a cup from the portion of stock by drawing the portion of stock across tangent points of the varied radius of curvature of the blank and draw punch curved edge.

According to one embodiment, forming the cup from the portion of stock further includes controlling a variance of a height of a top edge of the cup.

According to another embodiment, the method further includes receiving the cup at another tooling station spaced from the first tooling station, the other tooling station having a draw-redraw die comprising a draw-redraw die curved edge disposed between a draw-redraw die inner circumferential wall and a draw-redraw die proximal surface, the draw-redraw die curved edge having a radius of curvature that varies along its circumference. The method further includes forming, via the draw-redraw die, a can having a flange from the cup by redrawing the formed cup across tangent points of the varied radius of curvature of the draw-redraw die curved edge.

In one embodiment, forming the can having the flange further includes controlling a variance of a flange width around an outer circumference of the flange.

Embodiments provide a method of forming containers that includes receiving a stock element at a tooling station having a blank and draw punch. The blank and draw punch includes a blank and draw punch curved edge disposed between a blank and draw punch inner circumferential wall and a blank and draw punch proximal surface. The blank and draw punch curved edge has a radius of curvature that varies along its circumference. The method also includes blanking off a portion of stock from the stock element using the blank and draw punch and moving, at the tooling station, the blank and draw punch and a draw-redraw die from an open position to a cup forming position. The draw-redraw die has a draw-redraw die curved edge disposed between a draw-redraw die inner circumferential wall and a draw-redraw die proximal surface. The method also includes forming, between the blank and draw punch and the draw-redraw die at the tooling station, a cup from the portion of stock by drawing the portion of stock across tangent points of the varied radius of curvature of the blank and draw punch curved edge. The method further includes moving, at the tooling station, the blank and draw punch and the draw-redraw die to a can forming position and forming, via the draw-redraw die at the tooling station, a can having a flange from the cup by redrawing the formed cup across tangent points of the varied radius of curvature of the draw-redraw die curved edge.

According to one embodiment, forming the can having the flange further includes controlling a variance of a flange width around the outer circumference of the flange.

Embodiments provide a method of forming containers that includes receiving a stock element at a plurality of tooling stations of a die assembly. Each of the plurality of tooling stations having a blank and draw punch includes a blank and draw punch curved edge disposed between a blank and draw punch inner circumferential wall and a blank and draw punch proximal surface. The blank and draw punch curved edge has a radius of curvature that varies along its circumference. The method also includes blanking off a portion of stock from the stock element using the blank and draw punch at each tooling station and moving, at each tooling station, the blank and draw punch and a draw-redraw die from an open position to a cup forming position. Each draw-redraw die has a draw-redraw die curved edge disposed between a draw-redraw die inner circumferential wall and a draw-redraw die proximal surface. The method also includes forming, between the blank and draw punch and the draw-redraw die at each tooling station, a cup from the portion of stock by drawing the portion of stock across tangent points of the varied radius of curvature of the blank and draw punch curved edge. The method further includes moving the blank and draw punch and the draw-redraw die at each tooling station to a can forming position and forming, at each tooling station, a can having a flange from the cup by redrawing the formed cup across tangent points of the varied radius of curvature of the draw-redraw die curved edge.

Embodiments provide a double action tooling station for forming containers that includes an outer slide having a blank and draw punch configured to blank off a portion of stock from a stock element, the blank and draw punch further having a blank and draw punch inner circumferential wall defining a blank and draw punch cavity; a blank and draw punch proximal surface extending substantially perpendicular to the blank and draw punch inner circumferential wall; and a blank and draw punch curved edge disposed between the blank and draw punch inner circumferential wall and the blank and draw punch proximal surface, the blank and draw punch curved edge having a radius of curvature that varies along its circumference. The blank and draw additionally supplies draw pressure to the blank. The double action tooling station also includes an inner slide having a draw punch configured to draw the portion of stock to form a cup, the draw punch further having a punch center have a radius of curvature that varies along its circumference, where the outer slide is configured to move independently of the inner slide.

According to one embodiment the blank and draw punch is configured to form the cup by the inner slide drawing the portion of stock across tangent points of the varied radius of curvature of the blank and draw punch curved edge.

According to one embodiment, the varied radius of curvature of the blank and draw punch curved edge is further configured to control a variance of a height of a top edge of the cup.

Additional features and advantages of this disclosure will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures:

FIG. 13 is a table showing test run results generated by using an exemplary die assembly as shown in FIG. 1 through FIG. 4.

DETAILED DESCRIPTION OF EXEMPLARY EMBODIMENTS

Figure 1:
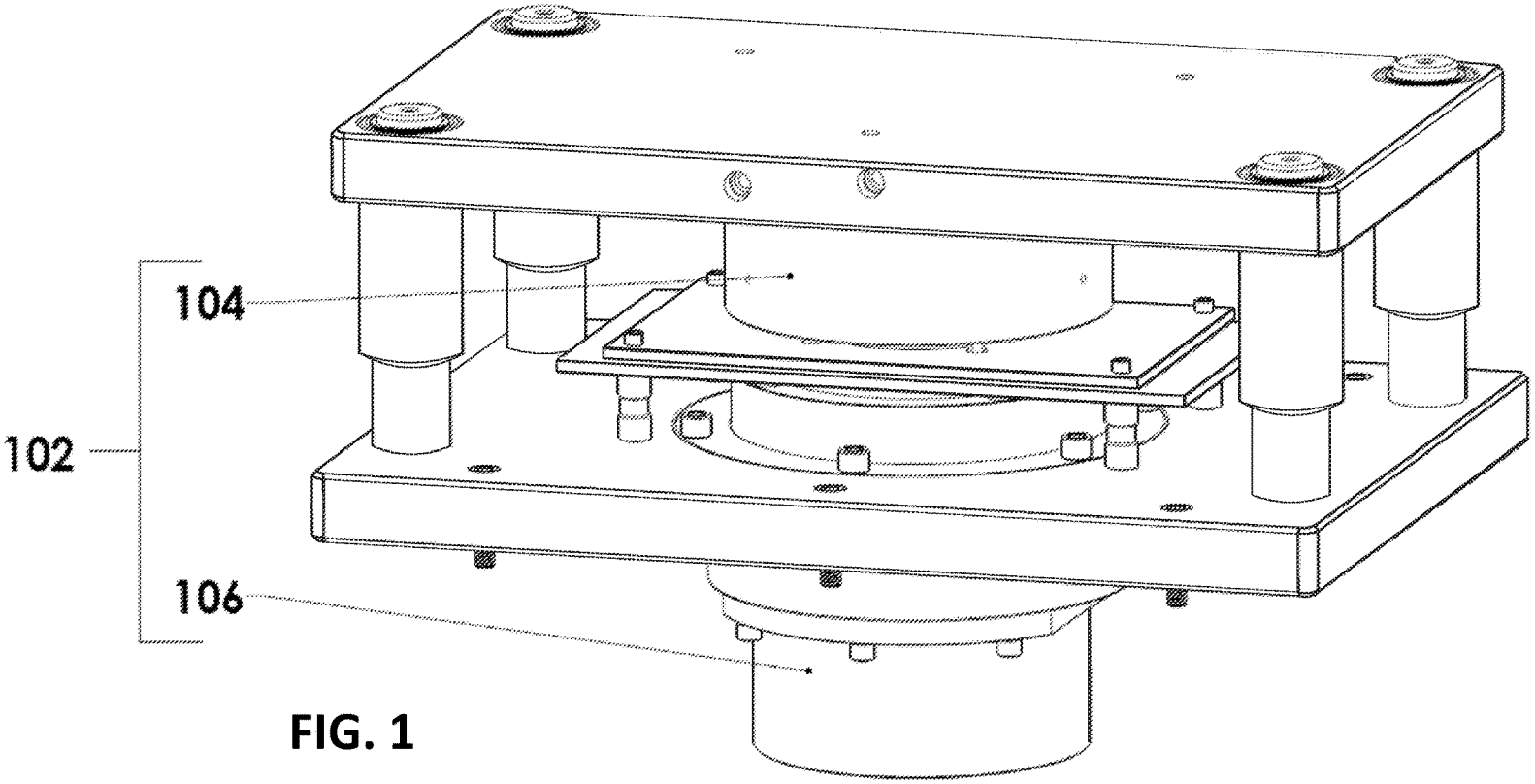
FIG. 1 is a perspective view of an exemplary die assembly having a single tooling station that includes an exemplary blank and draw punch and an exemplary draw-redraw die according to embodiments disclosed herein.

As described above, a portion of metal is blanked from a coil of stock to be drawn and formed into a cup. In conventional systems and methods, when the cup is formed, the height of the cup wall varies around the circumference of the cup at the cup top. That is, the metal is unevenly distributed at the cup top. For cans produced using the D&I process described above, the higher portions of the cans are subsequently trimmed off after the body maker elongates the cup body to provide the more evenly distributed cup top. The trimmed off portions are essentially wasted portions of materials (e.g., metal) that are not part of the produced can.

For cans produced using the DRD process described above, when the cup is redrawn to form the can, a flange is formed that extends from the can sidewall. The width of the flange from the can sidewall to the edge of the flange varies around the circumference of the flange. That is, the redrawing of the metal causes an earring effect by which portions of the flange are caused to be wider than other portions of the flange. Because it is desirable to have a minimum flange width and an evenly distributed (e.g., substantially round) flange width, a minimum amount of metal is blanked off the coil to provide the minimum flange width. The wider portions are subsequently trimmed off to provide the more evenly distributed flange width. The trimmed off portions are essentially wasted portions of metal that are not part of the produced can.

The minimum amount of metal blanked off the coil may be determined by the overall size of the radius continuously around the inner circumference of the draw punch. In some conventional metal container methods, when more metal is needed for the flange (e.g., the minimum width is not achieved), the overall size of the inner radius of the draw punch is decreased. That is, if the overall size of the inner radius of the draw punch is decreased, the metal is constricted and stretches to provide a taller cup providing more metal on the flange and a larger flange width. If the overall size of the inner radius of the draw punch is increased, the metal is less constricted to provide a shorter cup, thereby providing less metal on the flange and a smaller flange width. Reducing or increasing the overall size of the inner radius of the draw punch does not, however, prevent the uneven distribution of metal to the flange. That is, regardless of the overall size of the inner radius of the draw punch, the width of the flange from the can sidewall to the edge of the flange varies around the circumference of the flange.

The cost to produce each can includes the cost for the amount of metal used to form each can. Accordingly, if the portion of metal used to form the can is decreased, then the cost to produce each can decreases.

Embodiments disclosed herein provide a method and system that includes a blank and draw punch having varied inner radiuses to distribute the metal more evenly at the top of a cup. The varied inner radiuses of the blank and draw punch reduce the amount of metal to be trimmed off the cup top, thereby decreasing the cost of producing the cup.

Embodiments also provide a method and system that includes a draw-redraw die having varied inner radiuses to provide a more evenly distributed flange width. The varied inner radiuses of the draw-redraw die decrease the amount of metal used to form a can while maintaining a desirable minimum flange width around the outer circumference of the flange, thereby decreasing the cost to produce the can.

Embodiments provide a method and system that includes both a blank and draw punch having varied inner radiuses and a draw-redraw die having varied inner radiuses. The varied inner radiuses of the blank and draw punch and the draw-redraw die may each contribute to a more evenly distributed flange width. In some embodiments, the cup and the can may be formed at a single tooling station having both the blank and draw punch and the draw-redraw die. In other embodiments, the cup may be formed at one tooling station having the blank and draw punch and the can may be formed at a separate tooling station having the draw-redraw die.

According to another embodiment, the draw-redraw die can be configured to form a redrawn cup (i.e. no flange) by redrawing the formed cup across tangent points of the varied radius of curvature of the draw-redraw die curved edge.

FIG. 1 is a perspective view of an exemplary die assembly 100 having a single tooling station 102 according to embodiments disclosed herein. Tooling station 102 includes a blank and draw punch 104, a draw-redraw die 106 and a cut edge (shown as 108 at FIG. 3).

Figure 2:
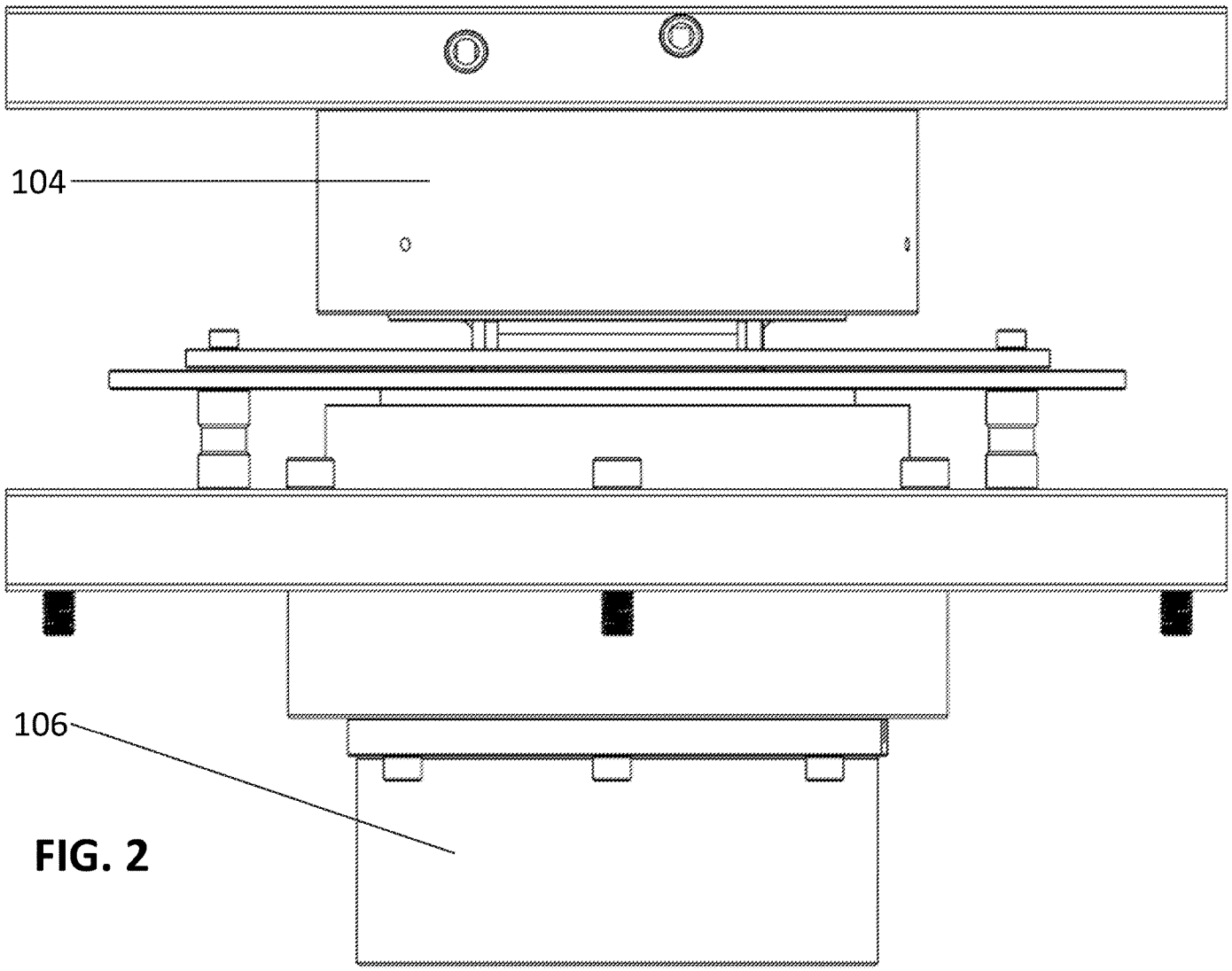
FIG. 2 is a side view of the exemplary die assembly shown at FIG. 1.
Figure 3:
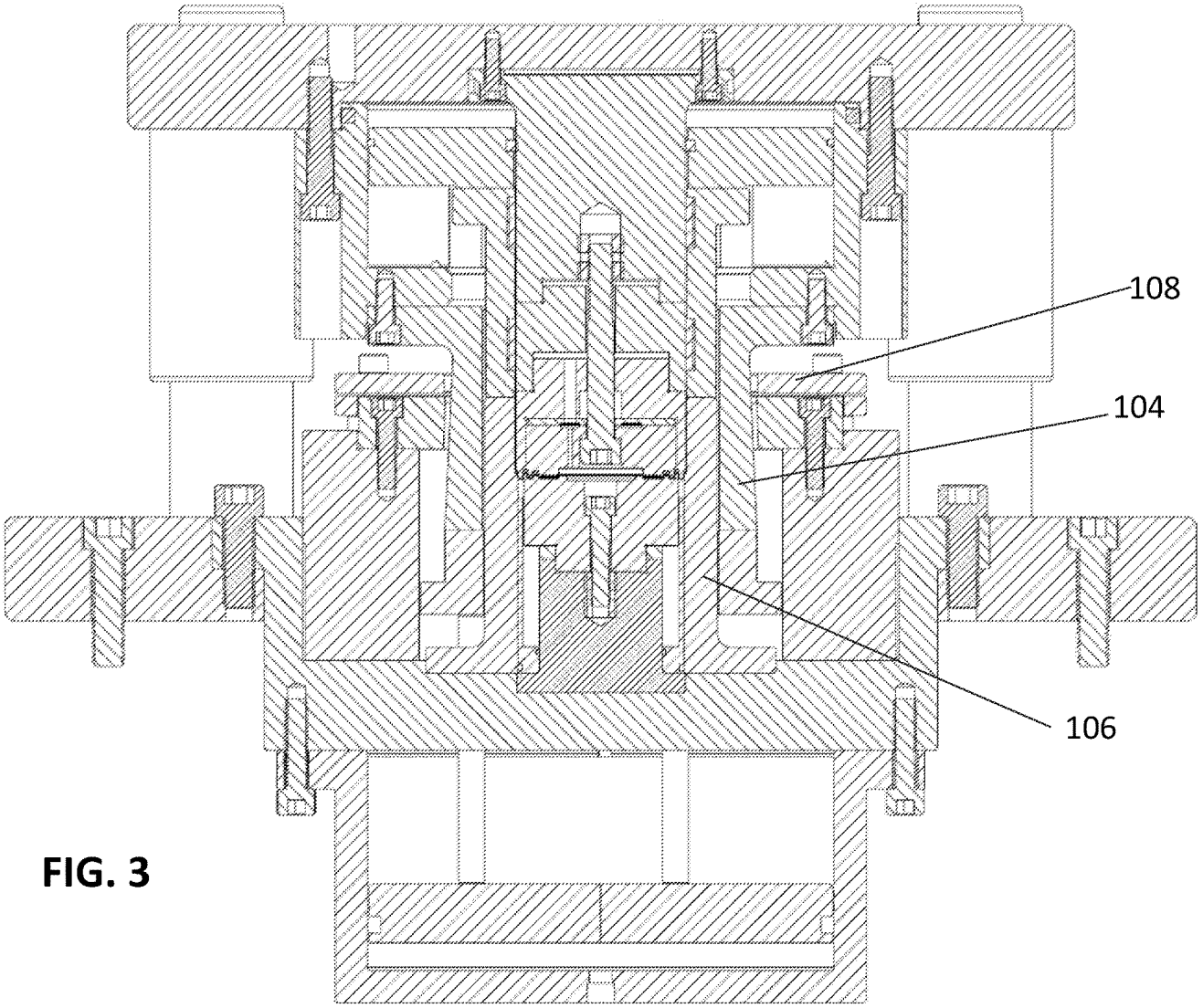
FIG. 3 is a cross sectional view at section A-A of the exemplary die assembly shown at FIG. 2.

FIG. 2 is a side view of the exemplary die assembly shown at FIG. 1. FIG. 3 is a cross sectional view at section A-A of the exemplary die assembly shown at FIG. 2.

Figure 4:
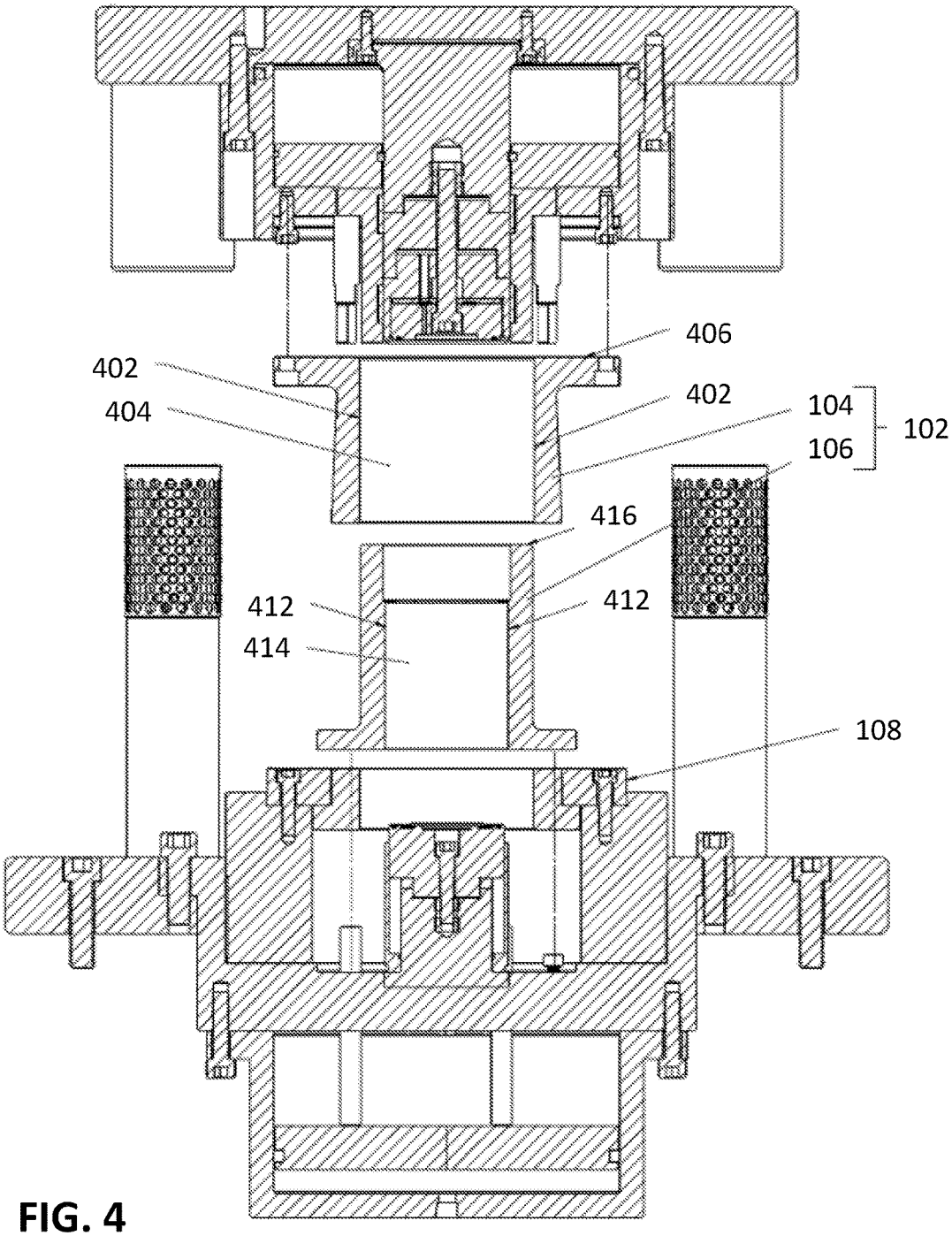
FIG. 4 is an exploded cross sectional view of the exemplary die assembly shown at FIG. 3.
Figure 5B:
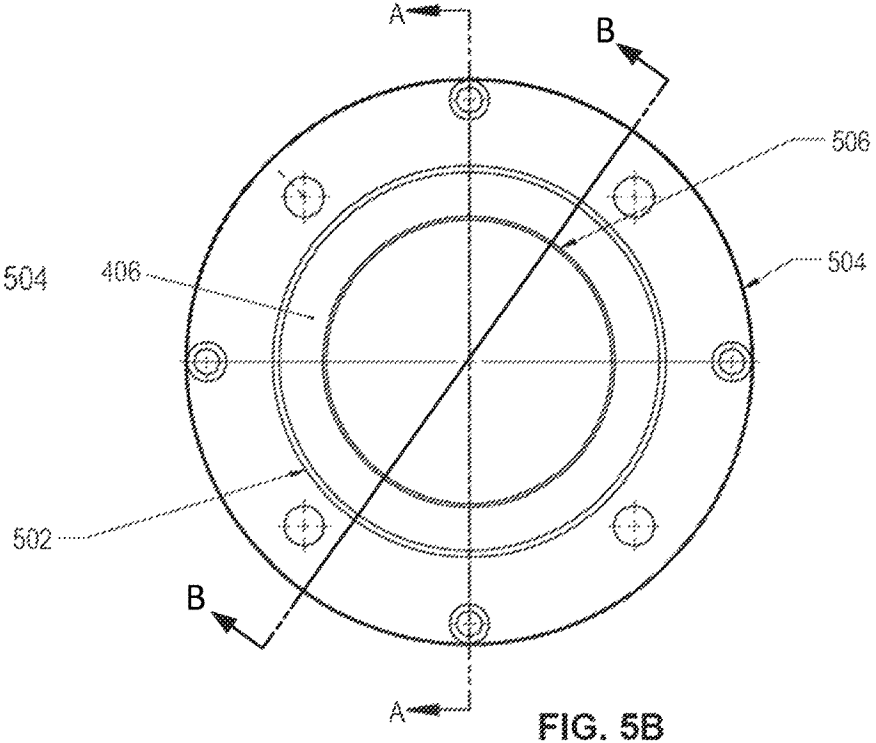
FIG. 5B is a top view of the exemplary blank and draw punch shown in FIG. 5A.
Figure 5A:
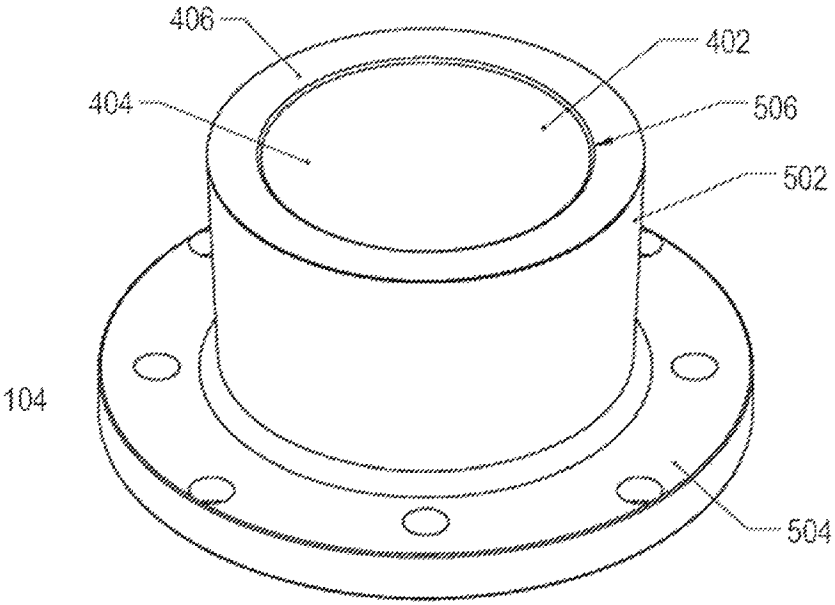
FIG. 5A is a perspective view of the exemplary blank and draw punch shown in FIG. 1 through FIG. 4.
Figure 5C:
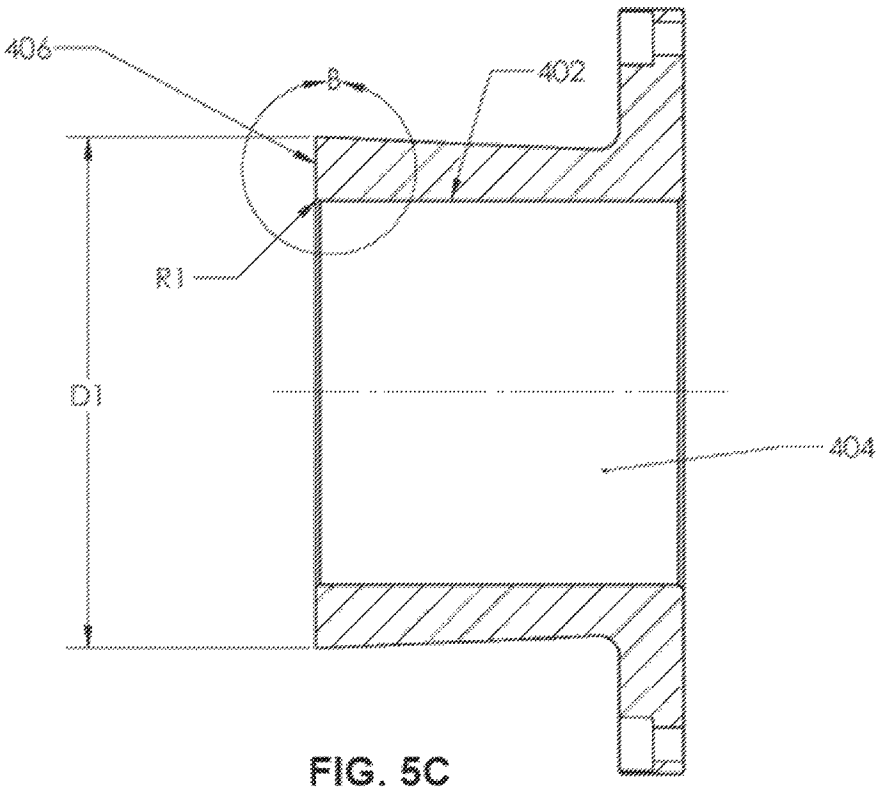
FIG. 5C is a cross sectional view at section A-A of the exemplary blank and draw punch shown in FIG. 5B.
Figure 5D:
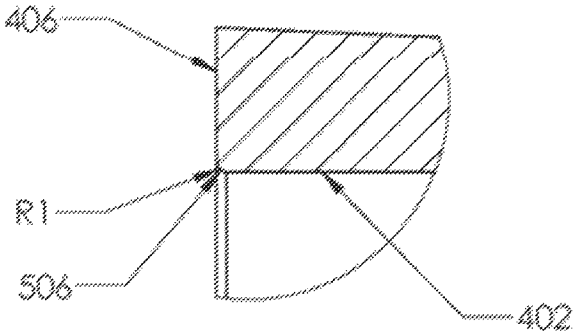
FIG. 5D is a close-up view of detail B of the exemplary blank and draw punch shown in FIG. 5C illustrating an exemplary blank and draw punch curved edge.
Figure 5E:
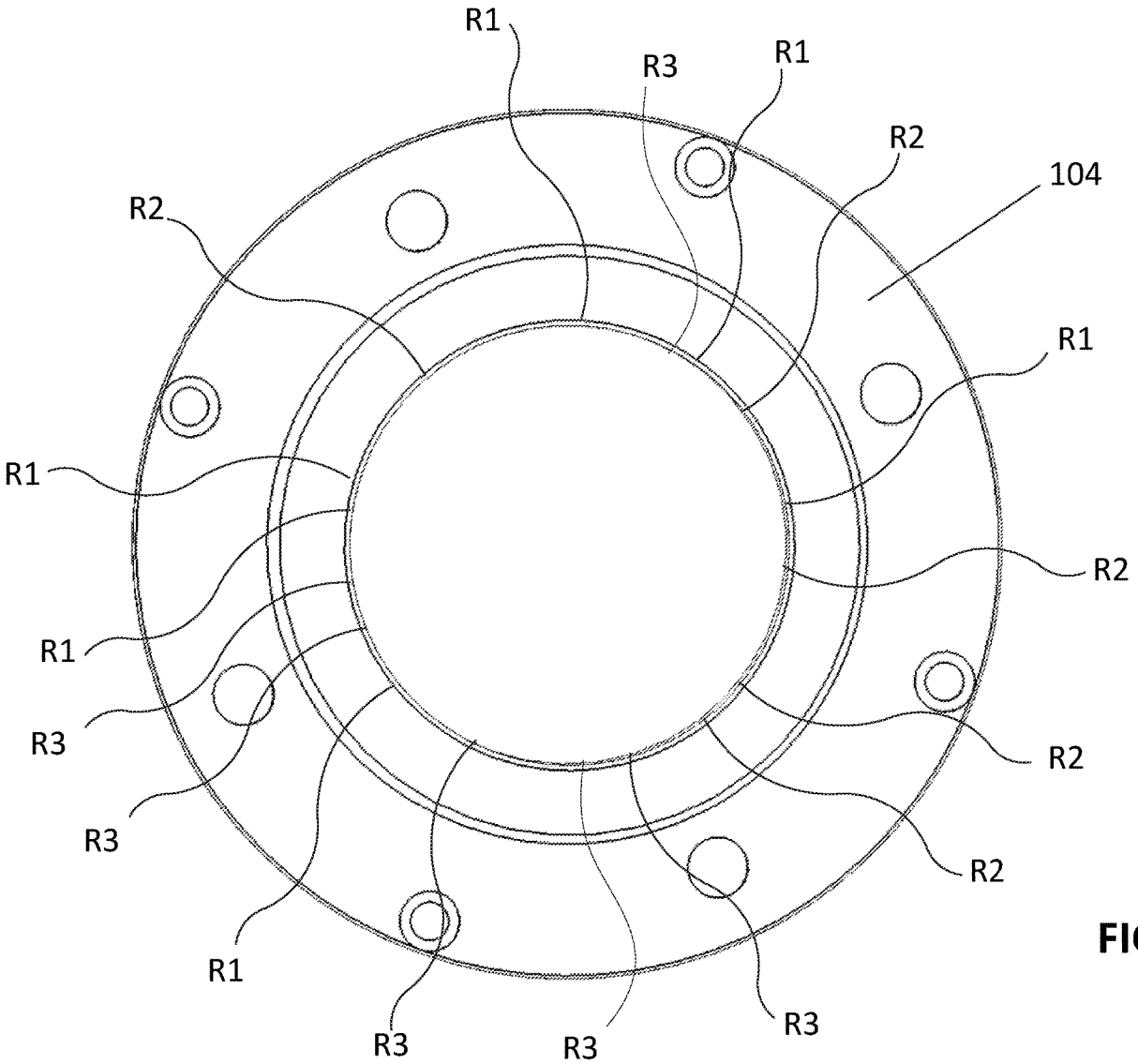
FIG. 5E is a top view of the exemplary blank and draw punch illustrating a blank and draw punch curved edge having an exemplary varying radius along its circumference.
Figure 5G:
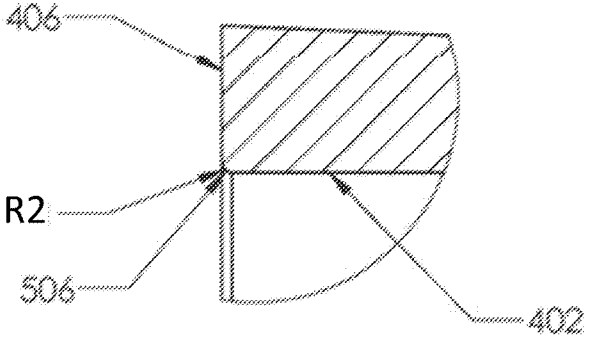
FIG. 5G is a close-up view of detail C of the exemplary blank and draw punch shown in FIG. 5F illustrating another exemplary blank and draw punch curved edge.
Figure 5F:
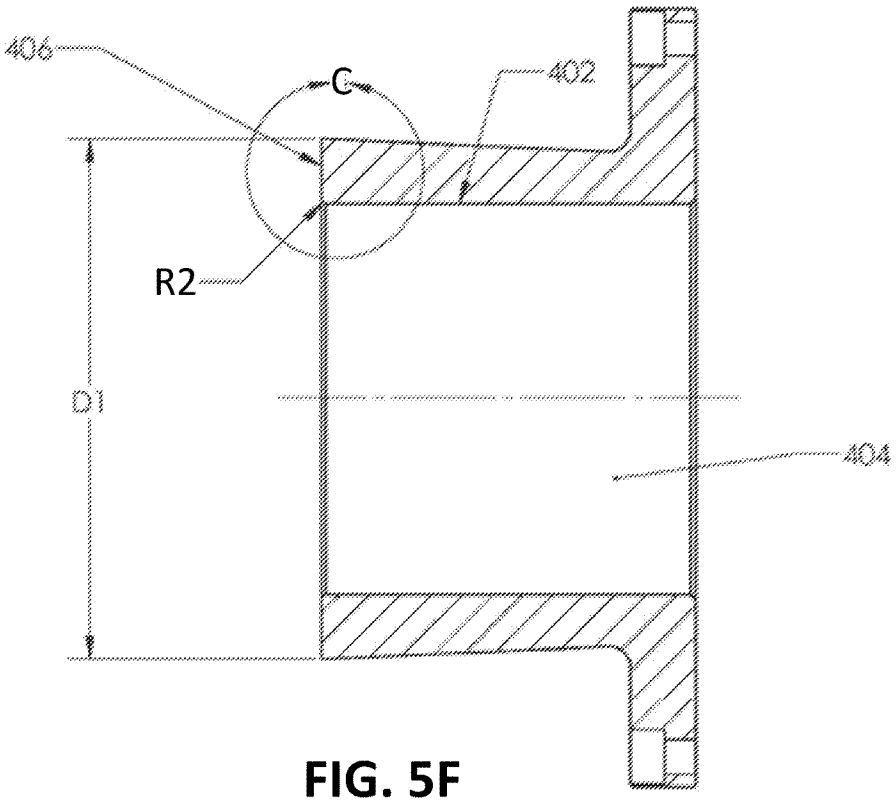
FIG. 5F is a cross sectional view at section B-B of the exemplary blank and draw punch shown in FIG. 5B.

FIG. 4 is an exploded cross sectional view of the exemplary die assembly 100 shown in FIG. 3. FIG. 5A is a perspective view of the blank and draw punch 104 shown in FIG. 1 through FIG. 4. FIG. 5B is a top view of the blank and draw punch 104 shown in FIG. 5A. FIG. 5C is a cross sectional view at section A-A shown in FIG. 5B. FIG. 5D is a close-up view of detail B shown in FIG. 5C illustrating a blank and draw punch curved edge 506 having a radius of curvature value R1. FIG. 5E is a top view of the blank and draw punch 104 illustrating a blank and draw punch curved edge 506 having an exemplary varying radius (radius values R1, R2, and R3) along its circumference. FIG. 5F is a cross sectional view at section B-B shown in FIG. 5B. FIG. 5G is a close-up view of detail C shown in FIG. 5F illustrating the blank and draw punch curved edge 506 at another circumferential location and having a radius of curvature value R2.

Figure 10:
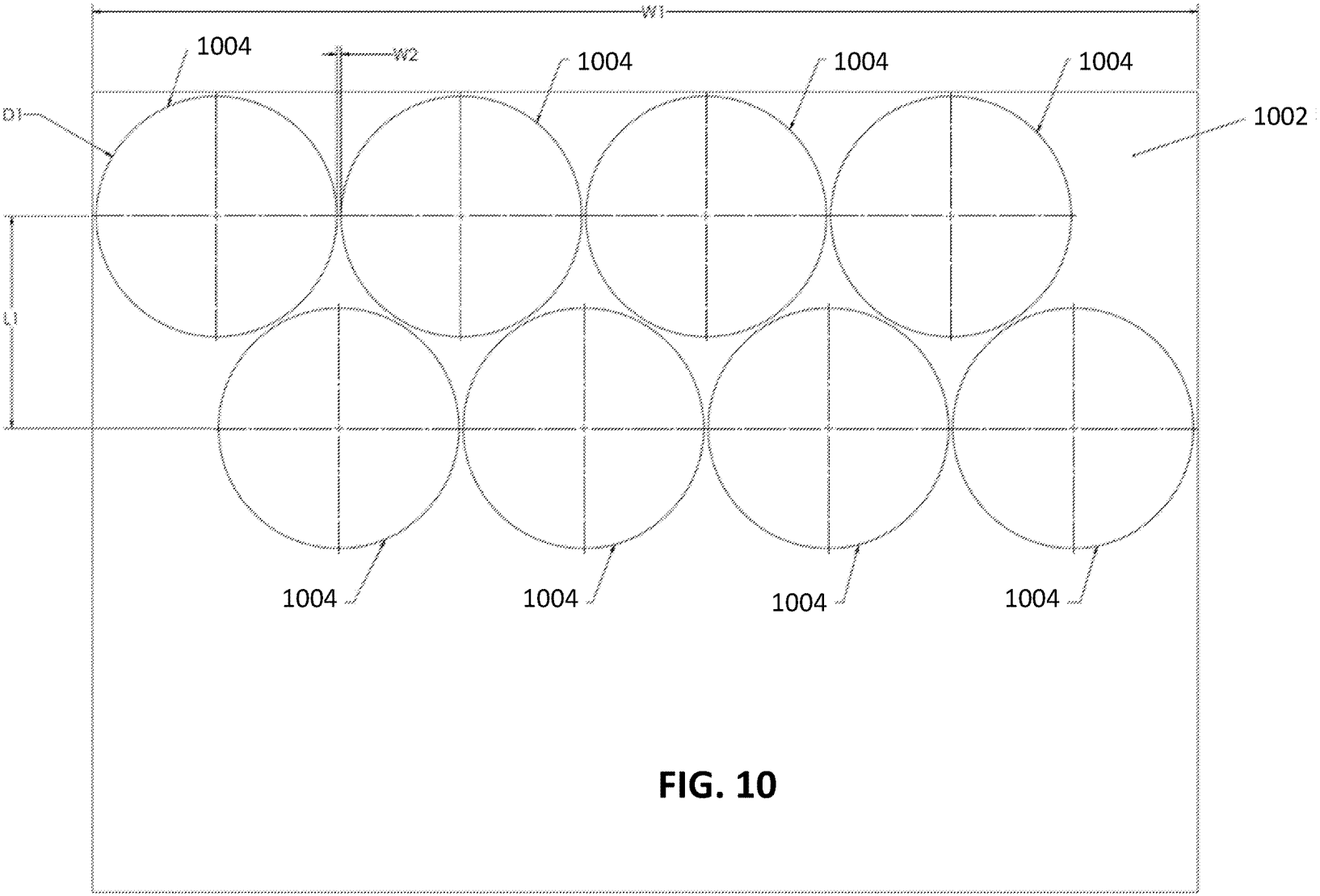
FIG. 10 is a top view of an exemplary stock element illustrating a plurality of portions of metal to be blanked off of the stock element position according to embodiments disclosed herein.

The blank and draw punch 104 is configured to blank off a portion of stock (e.g., metal) from a stock element 1002 shown at FIG. 10. In some embodiments, such as the embodiment shown in FIG. 10, the stock element is a stock coil 1002. In other embodiments, the stock element may be a stock sheet. Stock may include any metal material such as aluminum, steel, and metal alloys. Stock coils may be uncoiled and continuously provided to a machine (e.g., blank and draw punch or a draw-redraw die), a tooling station having one or more machines or a die assembly having a plurality of tooling stations.

As shown in FIG. 4 and FIGS. 5A-5G, the blank and draw punch 104 includes a blank and draw punch base 504 and a blank and draw punch cylindrical portion 502 extending from the blank and draw punch base 504. The size and shape of the blank and draw punch base 504 and blank and draw punch base cylindrical portion 502 shown in the embodiment at FIG. 4 and FIGS. 5A-5G is merely exemplary. Embodiments may include blank and draw punch bases and blank and draw punch base cylindrical portions having other shapes and sizes.

The blank and draw punch 104 also includes an inner circumferential wall 402 defining a blank and draw punch cavity 404 and a blank and draw punch proximal surface 406 extending substantially perpendicular to the blank and draw punch inner circumferential wall 402. The blank and draw punch 104 also includes a blank and draw punch curved edge 506 disposed between the blank and draw punch inner circumferential wall 402 and the blank and draw punch proximal surface 406.

As shown in the cross sectional view at FIG. 5C and the detailed view of FIG. 5D, blank and draw punch curved edge 506 that includes a radius of curvature R1 at a point along the curved edge circumference. As shown at FIG. 5E, the radius of curvature of the blank and draw punch curved edge 506 varies (R1, R2 Rn) along its circumference. For example, as shown in the cross sectional view at FIG. 5F, taken at a circumferential location that that differs from that of FIG. 5C (line B-B of FIG. 5B instead of line A-A) and the detailed view of FIG. 5G, blank and draw punch curved edge 506 includes another radius of curvature R2 at another point along the curved edge circumference. The curved edge 506 of the blank and draw punch 104 is configured such that the cup is formed by drawing the metal across tangent points of the varied radius of curvature of the blank and draw punch curved edge 506.

The values (R1, R2, R3) shown in FIG. 5E may correspond to a plurality of equally spaced points along the circumference of the curved edge 506. The equally spaced points are merely exemplary to show that the radius of curvature along the circumference varies. Embodiments may include curved edges with radiuses having varying values at any points along the circumference. Curved edges may have radius values that vary in equal segments and unequal segments. The number of values (R1, R2, R3) shown in the embodiment in FIG. 5E is merely exemplary.

Embodiments may include curved edges having any number varying radiuses values (R1, R2, . . . Rn).

Embodiments may include different methods of selecting the radius values (R1, R2, . . . Rn). In one embodiment, one or more cups may be produced using the blank and draw punch 104 having a first curved edge 506. After the one or more cans are produced, the distribution of the metal along a cup top surface 802 (shown in FIG. 8B) may be measured. The variance of a height H of cup 802 around an outer circumference of the cup may be controlled by varying the radius of curvature at any number of points or segments along the curved edge circumference to adjust the distribution of the metal of the cup height H at a top 804 of cup 802 around the circumference of the cup 802. Further, any number of radius values (R1, R2, . . . Rn) may be used to control the variance of the height H of the cup 802.

Figure 6B:
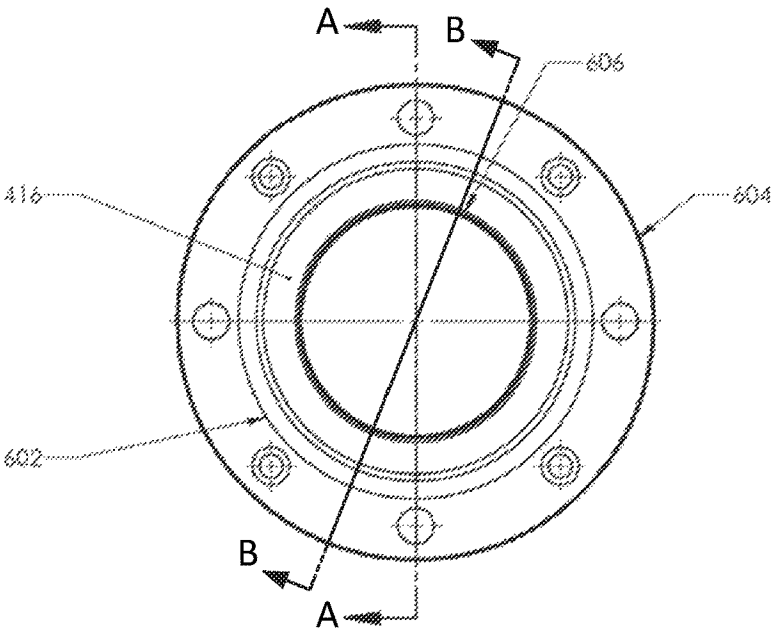
FIG. 6B is a top view of the exemplary draw-redraw die shown in FIG. 6A.
Figure 6A:
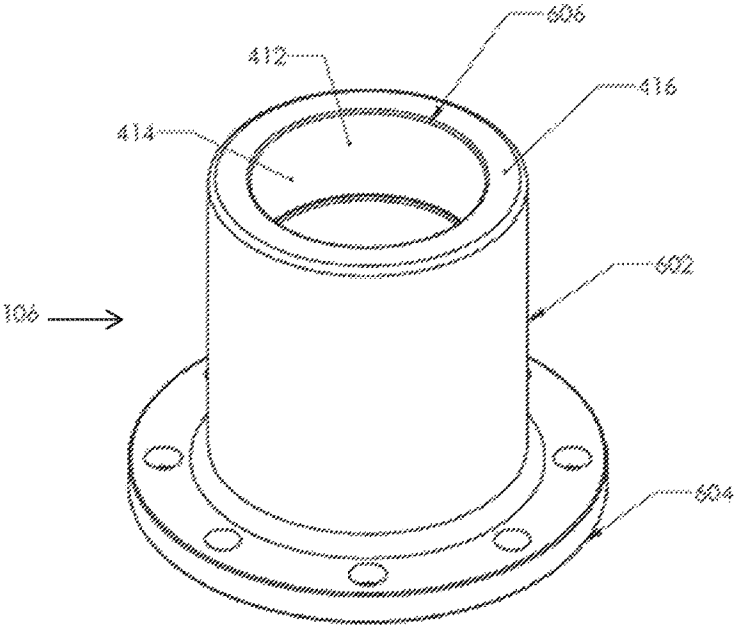
FIG. 6A is a perspective view of the exemplary draw-redraw die shown in FIG. 1 through FIG. 4.
Figure 6D:
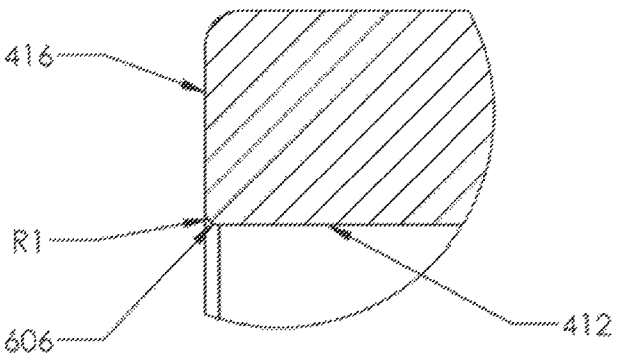
FIG. 6D is a close-up view of detail B of the exemplary draw-redraw die shown in FIG. 6C illustrating an exemplary draw-redraw die curved edge.
Figure 6C:
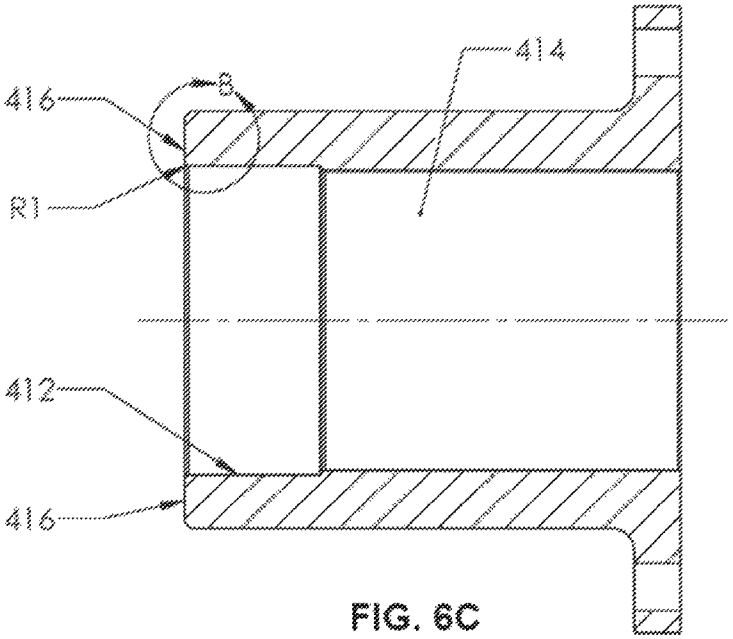
FIG. 6C is a cross sectional view at section A-A of the exemplary draw-redraw die shown in FIG. 6B.
Figure 6E:
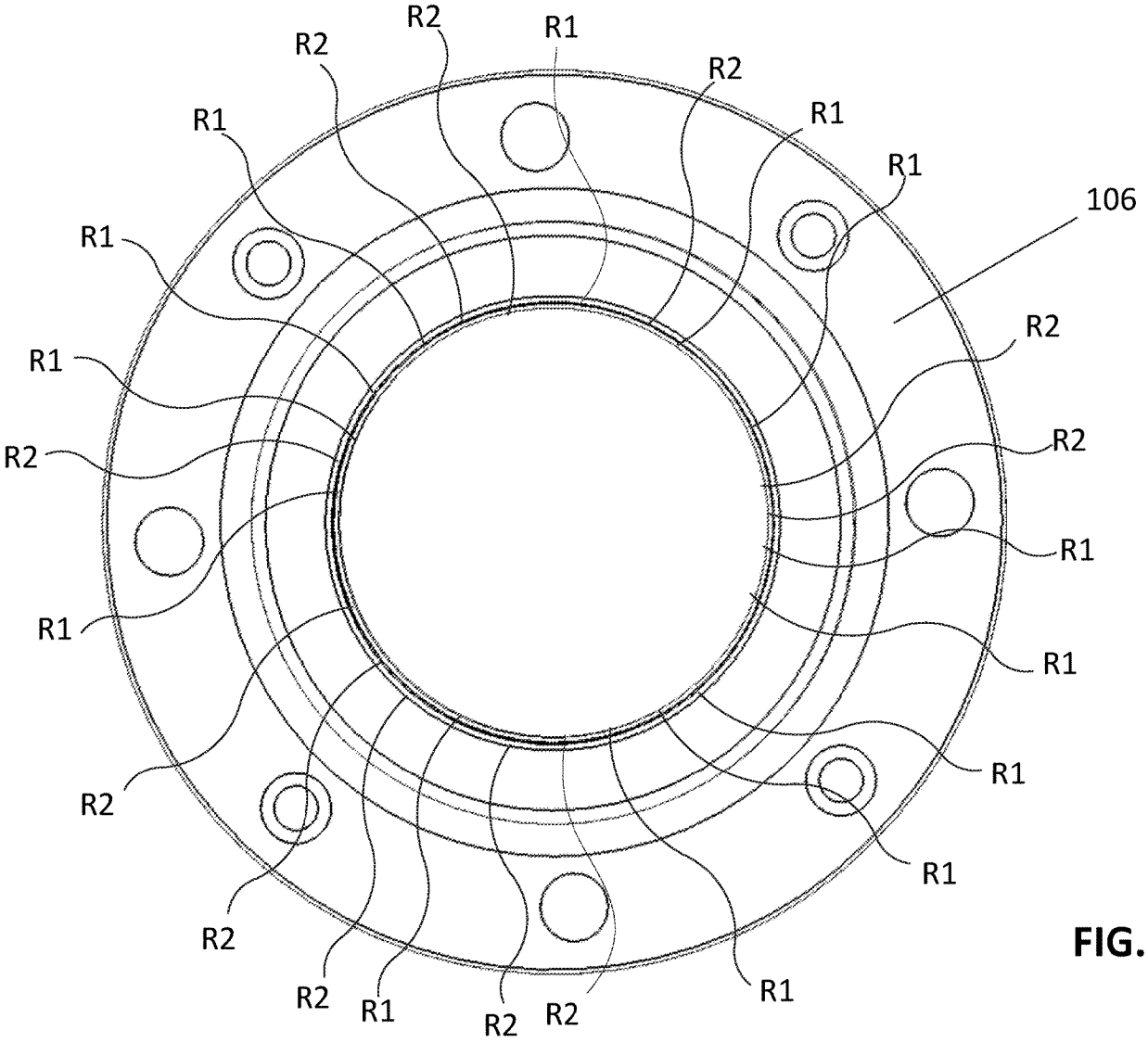
FIG. 6E is a top view of the draw-redraw die illustrating a draw-redraw die curved edge having an exemplary varying radius along its circumference.
Figure 6F:
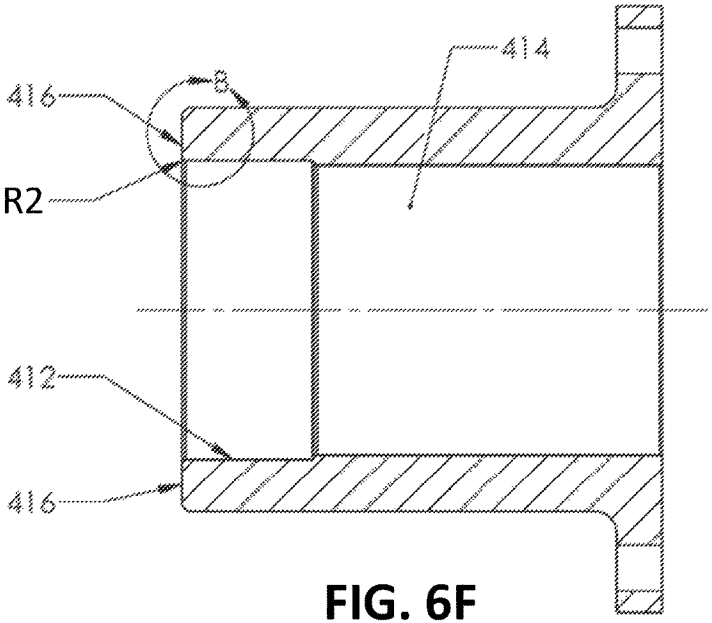
FIG. 6F is a cross sectional view at section B-B of the exemplary draw-redraw die shown in FIG. 6B.
Figure 6G:
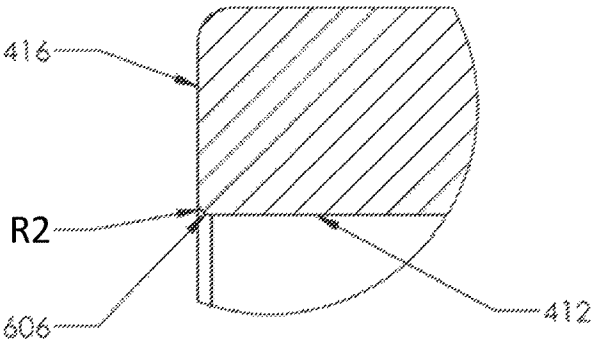
FIG. 6G is a close-up view of detail C of the exemplary draw-redraw die shown in FIG. 6F illustrating another exemplary draw-redraw die curved edge.

FIG. 6A is a perspective view of the draw-redraw die 106 shown in FIG. 1 through FIG. 4. FIG. 6B is a top view of the draw-redraw die 106 shown in FIG. 6A. FIG. 6C is a cross sectional view at section A-A shown in FIG. 6B. FIG. 6D is a close-up view of detail B shown in FIG. 6C illustrating a draw-redraw die curved edge 606 having a radius of curvature value R1. FIG. 6E is a top view of the draw-redraw die 106 illustrating a draw-redraw die curved edge 606 having an exemplary varying radius (radius values R1 and R2) along its circumference. FIG. 6F is a cross sectional view at section B-B shown in FIG. 6B. FIG. 6G is a close-up view of detail C shown in FIG. 6F illustrating the draw-redraw die curved edge 606 at another circumferential location and having a radius of curvature value R2.

The draw-redraw die 106 is configured to redraw a cup (e.g., cup formed by blank and draw punch 104) to form a partially completed can (hereinafter can) having a flange. As shown in FIG. 4 and FIGS. 6A-6G, the draw-redraw die 106 includes a draw-redraw die base 604 and a draw-redraw die cylindrical portion 602 extending from the draw-redraw die base 604. The size and shape of the draw-redraw die base 604 and draw-redraw die base cylindrical portion 602 shown in the embodiment at FIG. 4 and FIGS. 6A-6G is merely exemplary. Embodiments may include draw-redraw die bases and draw-redraw die base cylindrical portions having other shapes and sizes.

The draw-redraw die 106 also includes an inner circumferential wall 412 defining a draw-redraw die cavity 414 and a draw-redraw die proximal surface 416 extending substantially perpendicular to the draw-redraw die inner circumferential wall 412. The draw-redraw die 106 also includes a draw-redraw die curved edge 606 disposed between the draw-redraw die inner circumferential wall 412 and the draw-redraw die proximal surface 416.

As shown in the cross sectional view at FIG. 6C and the detailed view of FIG. 6D, draw-redraw die curved edge 606 includes a radius of curvature R1 at a point along the curved edge circumference. For example, as shown in the cross sectional view at FIG. 6F, taken at a circumferential location that that differs from that of FIG. 6C (line B-B of FIG. 6B instead of line A-A) and the detailed view of FIG. 6G, draw-redraw die curved edge 606 includes another radius of curvature R2 at another point along the curved edge circumference. As shown at FIG. 6E, the radius of curvature of the draw-redraw die curved edge 606 varies (R1 and R2) along its circumference. The draw-redraw die 106 is configured to form a can (e.g., can 902 having flange 904 shown in FIG. 9B) by redrawing the formed cup (e.g., cup 802) across tangent points of the varied radius of curvature of the draw-redraw die curved edge 606.

The values (R1 and R2) shown in FIG. 6E may correspond to a plurality of equally spaced points along the circumference of the curved edge 606. The equally spaced points are merely exemplary to show that the radius of curvature along the circumference varies. Embodiments may include curved edges with radiuses having varying values at any points along the circumference. Curved edges may include radius values that vary in equal segments and unequal segments. The number of values (R1, R2, R3) shown in the embodiment in FIG. 6E is merely exemplary. Embodiments may include curved edges having any number of varying radiuses values (R1, R2, . . . Rn).

Embodiments may include different methods of selecting the radius values (R1, R2, . . . Rn). In one embodiment, one or more cans may be produced using the draw-redraw die 106 having a pre-varied curved edge. After one or more cans (e.g., can 902 having flange 904 shown in FIG. 9B) are produced, the distribution of the metal along a flange width W around an outer circumference of the flange 904 may be measured. The variance of the flange width W around an outer circumference of the flange 904 may be then be controlled by varying the radius of curvature at any number of points or segments along the curved edge circumference to adjust the distribution of the metal of the flange width W around the outer circumference of the flange 904. Further, any number of radius values (R1, R2, . . . Rn) may be used to control the variance of the flange width W.

The embodiment in FIG. 1 through FIG. 4 includes a blank and draw punch 104 and a draw-redraw die 106 at the same tooling station 102. In these embodiments, the cup 802 and the can 902 having flange 904 may be produced in the single tooling station 102 of die assembly 100. In other embodiments, the blank and draw punch 104 and a draw-redraw die 106 may be in separate tooling stations. In these embodiments, the blank and draw punch 104 may produce the cup 802 in one tooling before moving on to produce the can 902 with draw-redraw die 106 in a separate tooling station.

The die assembly 100 shown in FIG. 1 through FIG. 4 includes a single tooling station 102. In some embodiments, die assemblies may include a plurality of the tooling stations 102. In these embodiments, each of the plurality of tooling stations 102 may include a blank and draw punch 104 and a draw-redraw die 106. For example, each blank and draw punch 104 may be configured to blank off one of a plurality of portions of stock 1004 (shown in FIG. 10) from stock element 1000 to draw the corresponding portions of stock 1004 and form corresponding cups. Each draw-redraw die may then be used to redraw the cups to form corresponding cans in the die assembly.

As shown in FIG. 10, stock element 1000 includes a width W1. Each portion of stock 1004 has a diameter D1 and edges of the portions of stock 1004 are spaced from each other at a width W2. The center points of portions of stock 1004 in adjacent rows are spaced at a length L1. By varying the radius of curvature of the blank and draw punch curved edges and/or by varying the radius of curvature of the draw-redraw die curved edges, less metal may be used to make each cup. Accordingly, the diameters D1 of each portion 1004 may be reduced, which in turn may reduce the lengths L1 between the center points. In these embodiments where stock 1002 is a sheet, more portions 1004 may be used for the cost of a single sheet. In embodiments where stock 1002 is a coil, reducing the diameters D1 of each portion 1004 may produce more cans over a certain length of the metal coil.

In some embodiments, varying the draw radius of the blank and draw punch curved edges and/or varying the draw radius of the draw-redraw die curved edges produces more cans with the same amount of metal. In other embodiments, varying the draw radius of the blank and draw punch curved edges and/or varying the draw radius of the draw-redraw die curved edges produces the same amount of cans with less metal.

Figure 7A:
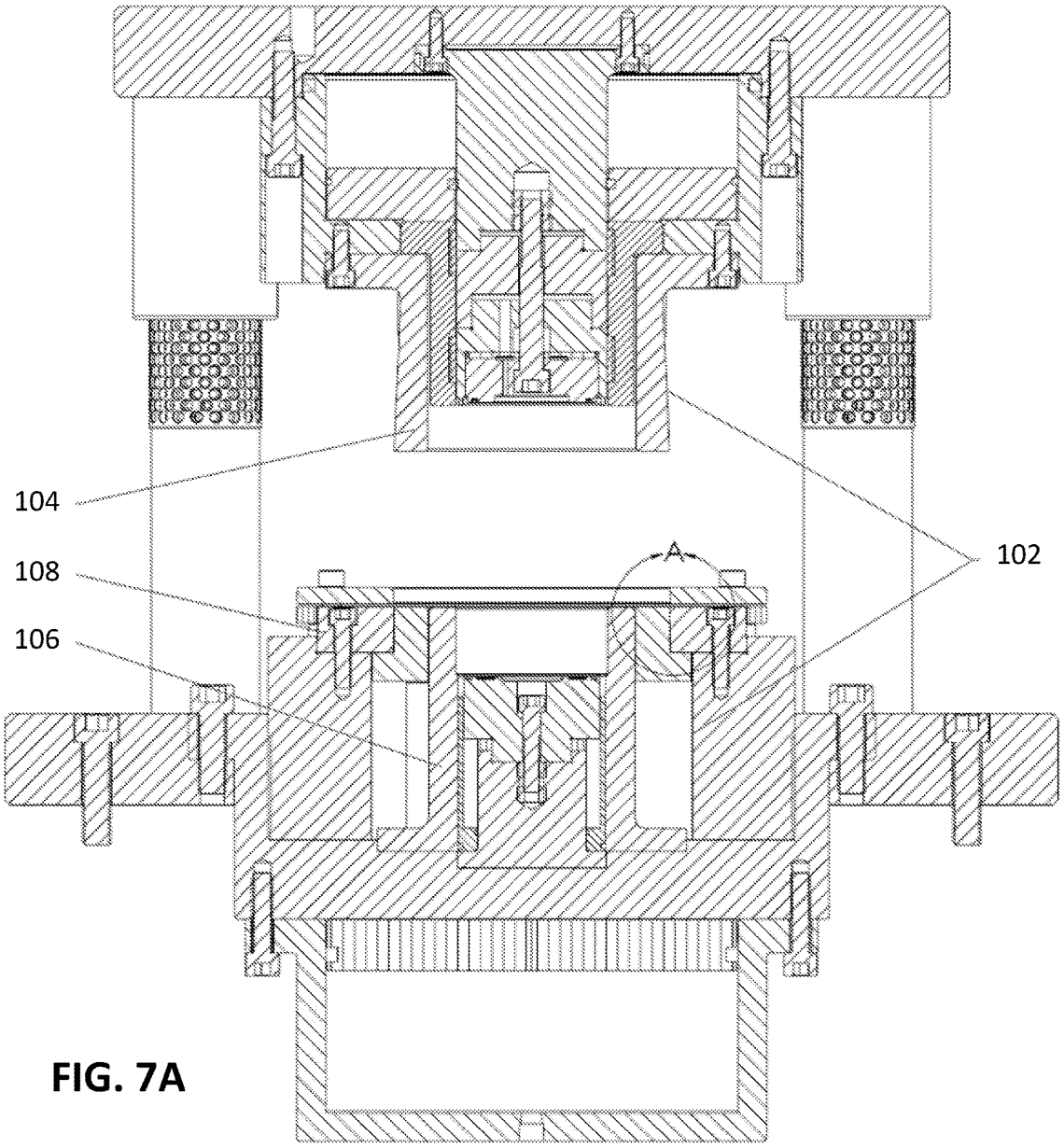
FIG. 7A is a cross sectional view of an exemplary die assembly in an open position according to embodiments disclosed herein.
Figure 7B:
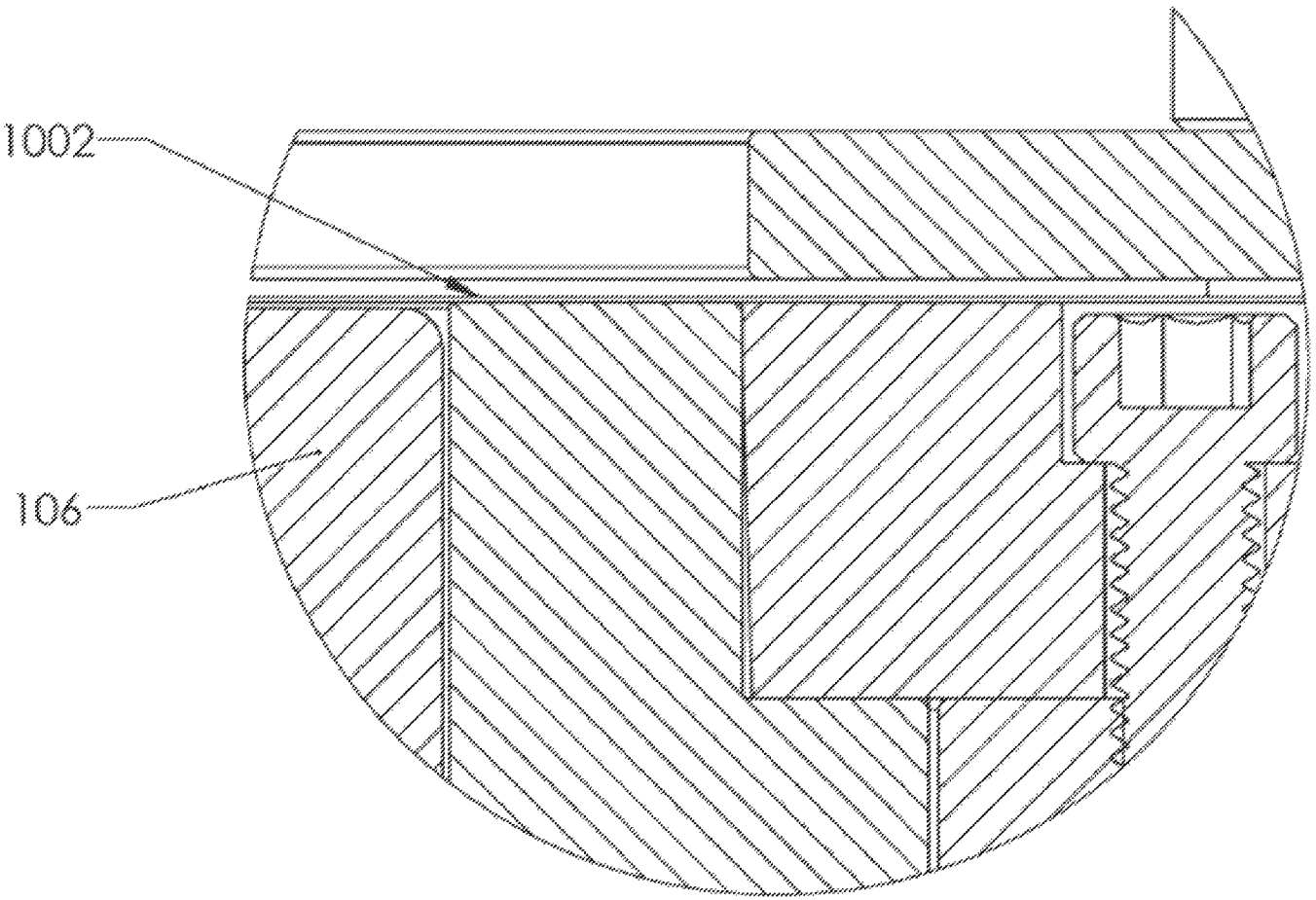
FIG. 7B is a close-up view of detail E shown in FIG. 7A illustrating a stock element prior to blanking.
Figure 8A:
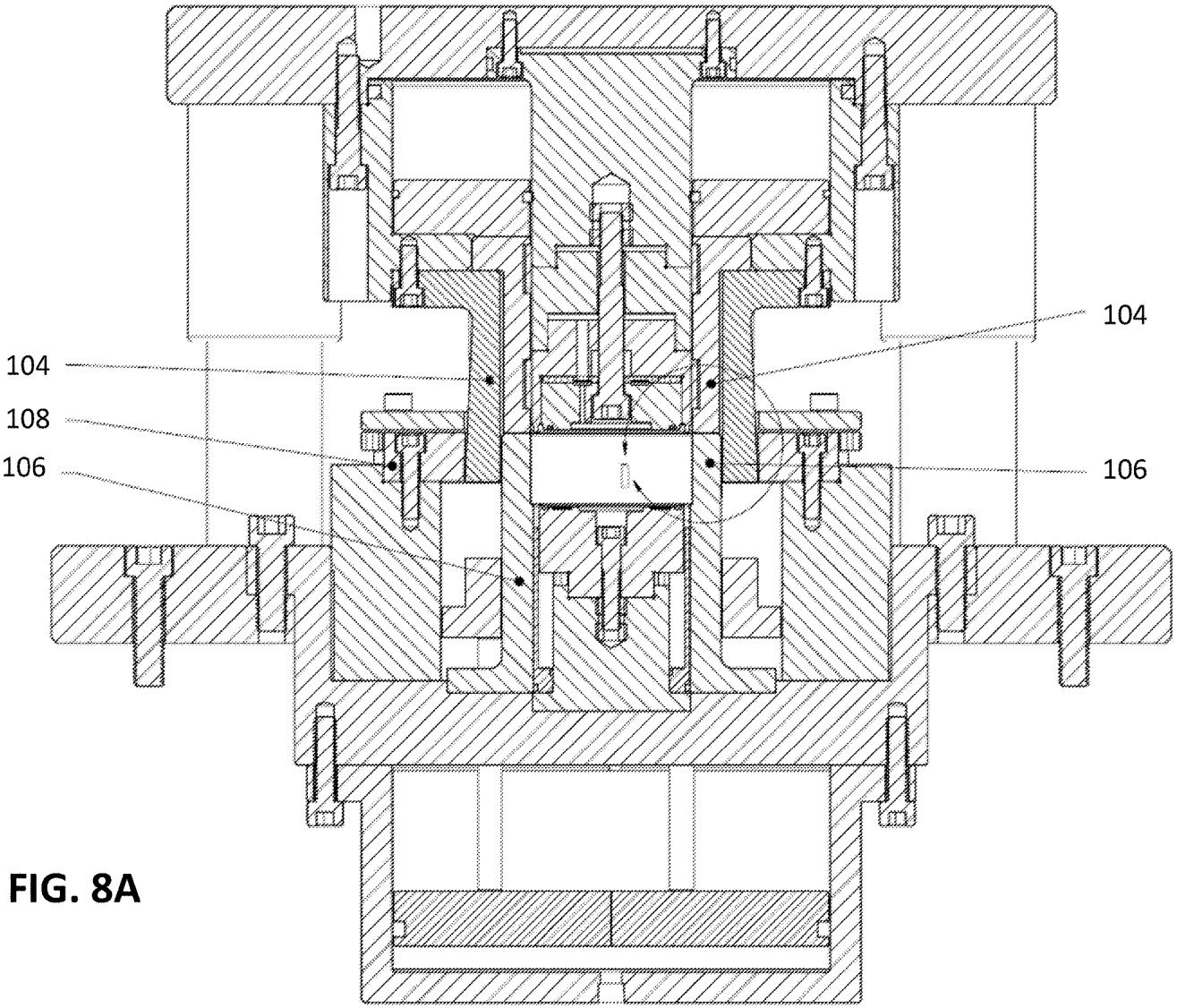
FIG. 8A is a cross sectional view of the exemplary die assembly shown in FIG. 7A illustrating the die assembly in a cup forming position according to embodiments disclosed herein.
Figure 8B:
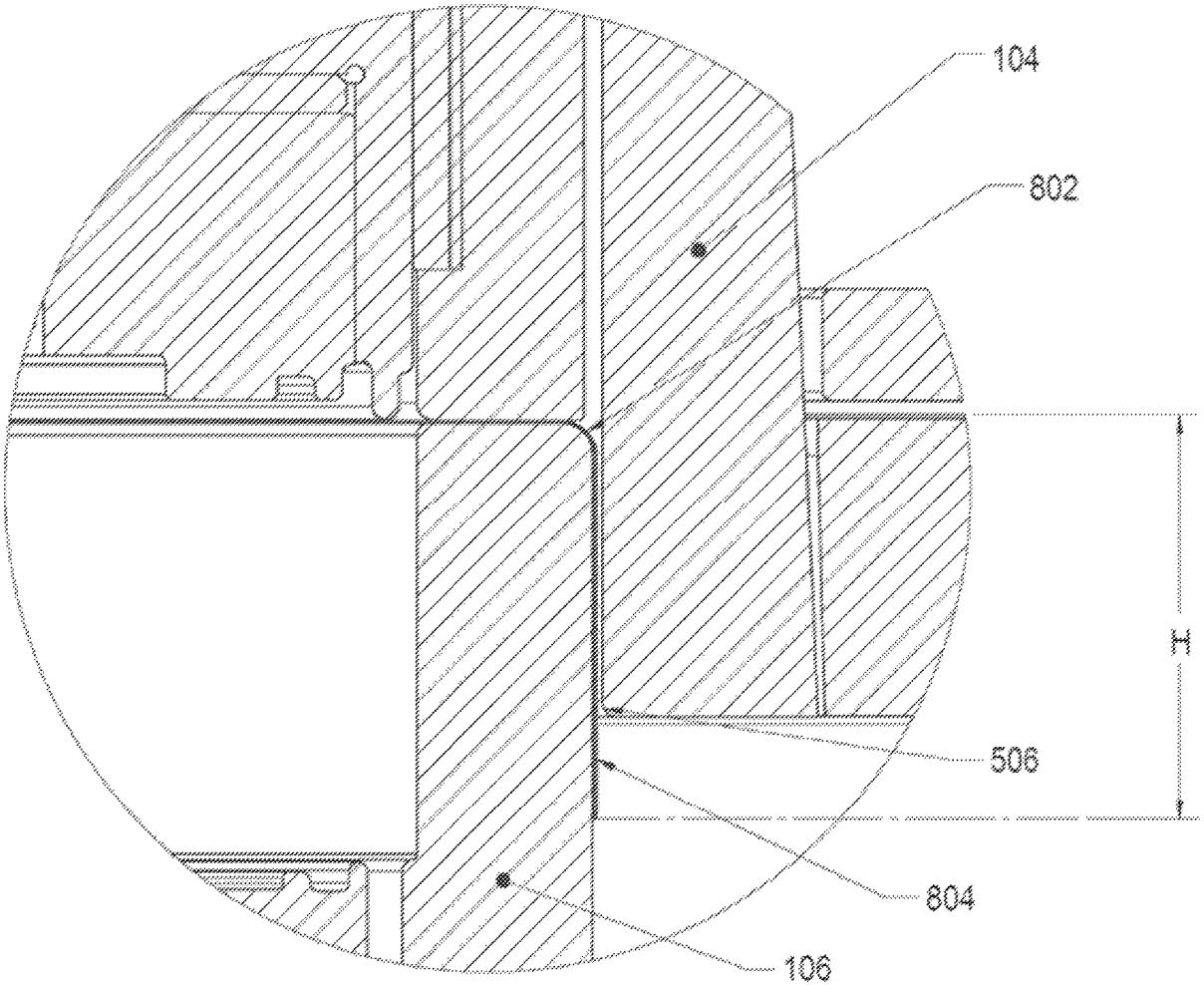
FIG. 8B is a close-up view of detail D shown in FIG. 8A illustrating a partially formed cup between the blank and punch and the draw-redraw die.
Figure 9A:
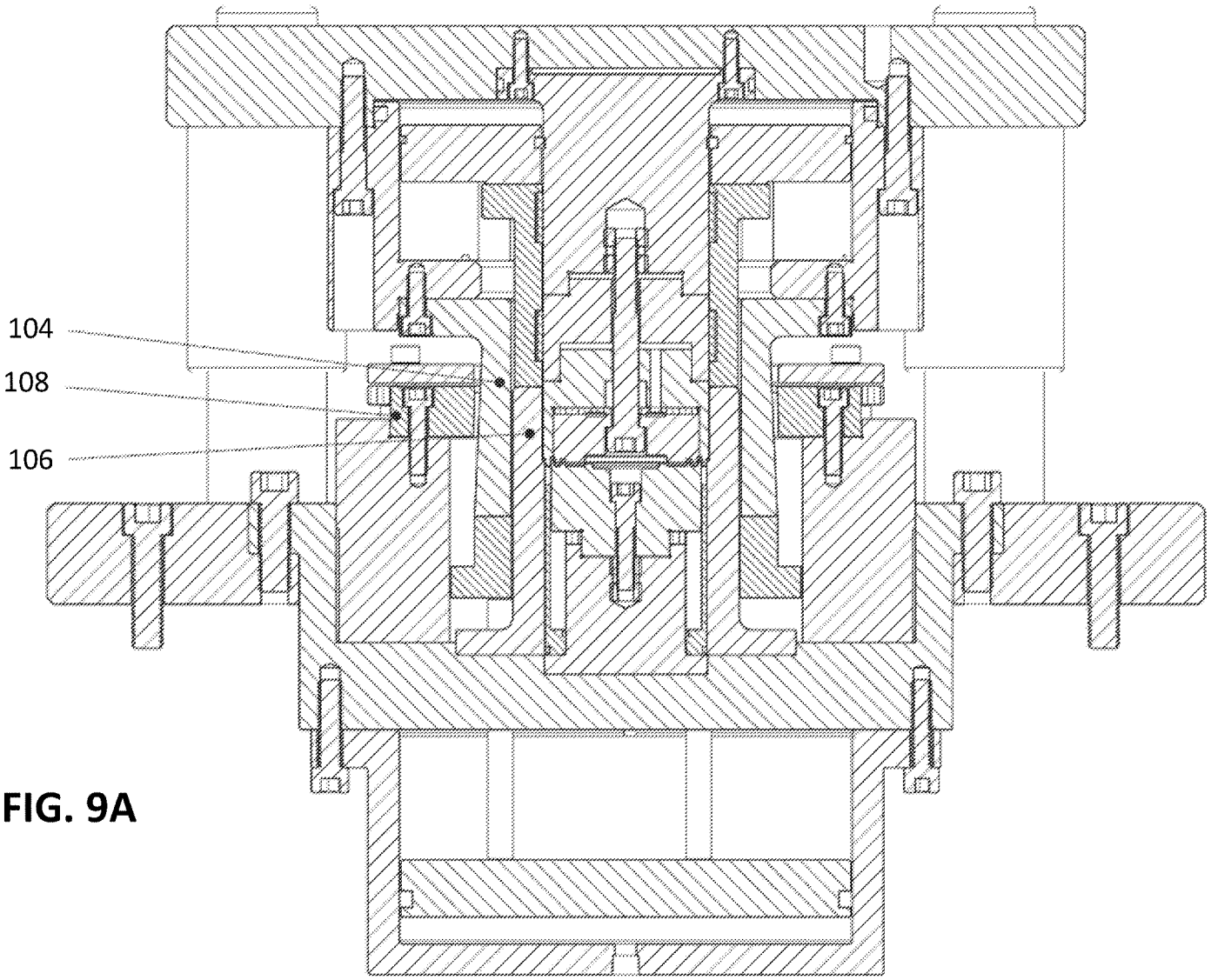
FIG. 9A is a cross sectional view of the exemplary die assembly shown in FIG. 7A illustrating the die assembly in a closed position according to embodiments disclosed herein.
Figure 9B:
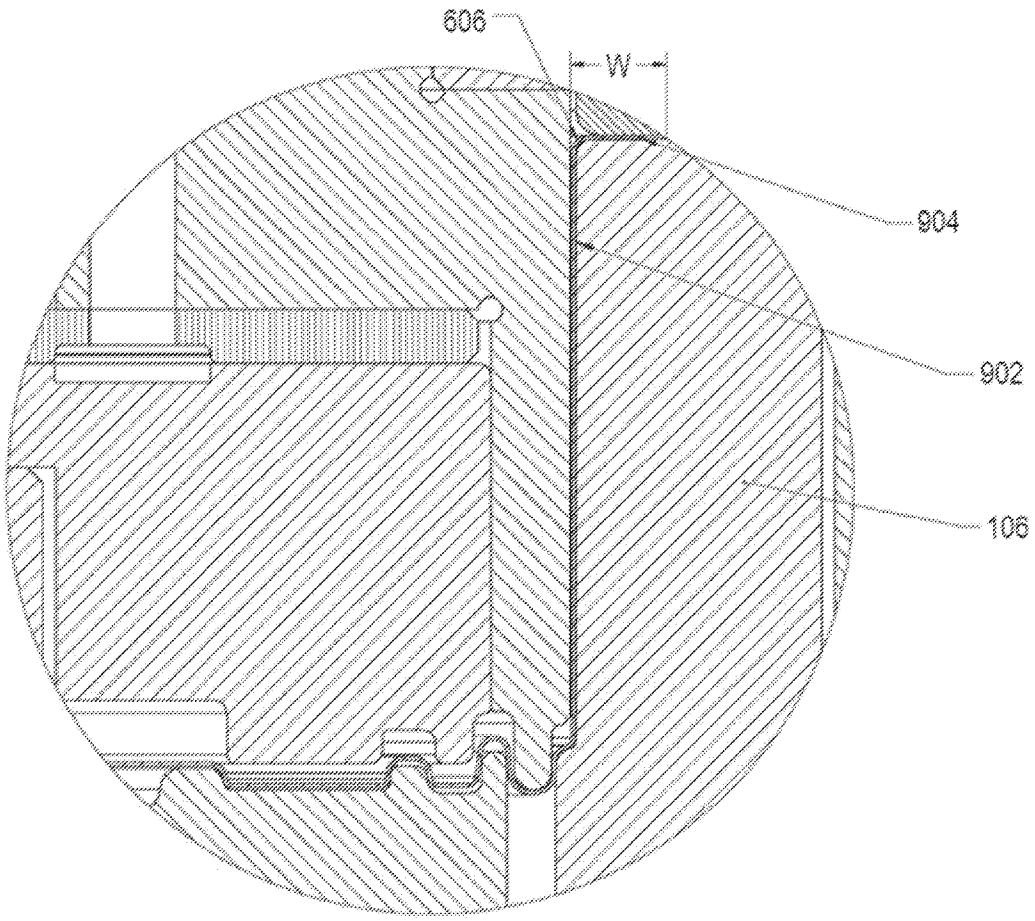
FIG. 9B is a close-up view of detail F shown in FIG. 9A illustrating a formed can.

FIG. 7A through FIG. 9B show different views of an exemplary die assembly 100 with a single tooling station 102 in different positions during the forming of a cup 802 and can 902 having a flange 904. FIG. 7A is a cross sectional view of an exemplary die assembly 100 in an open position according to embodiments disclosed herein. FIG. 7B is a close-up view of detail E shown in FIG. 7A illustrating a stock element (e.g., stock element 1002 shown in FIG. 10) prior to blanking. FIG. 8A is a cross sectional view of the exemplary die assembly 100 shown in FIG. 7A illustrating the die assembly 100 in a cup forming position according to embodiments disclosed herein. FIG. 8B is a close-up view of detail D shown in FIG. 8A illustrating a partially formed cup 804 between the blank and punch 104 and the draw-redraw die 106. FIG. 9A is a cross sectional view of the exemplary die assembly 100 shown in FIG. 7A illustrating the die assembly 100 in a closed position according to embodiments disclosed herein. FIG. 9B is a close-up view of detail F shown in FIG. 9A illustrating a partially formed cup 802.

Embodiments provide different methods for forming containers, such as a cup 802 and a can 902. Some embodiments provide a method of forming the cup 802 and the can 902 having a flange 904 in the in the same tooling station 102. This method will now be described with reference to FIGS. 7A through 9B.

The method includes receiving stock element 1002 at a tooling station 102 of die assembly 100 when the die assembly 100 is an open position, as shown at FIG. 7A and FIG. 7B. The method also includes blanking off a portion of stock via cut edge 108 from the stock element 1002. The cut edge 108 may blank off a portion in the shape of one of the portions 1004 shown in FIG. 10. The blank and draw punch 102 and draw-redraw die may be moved from the open position to a cup forming position as shown in FIG. 8A and FIG. 8B.

The method also includes forming a cup 802 from the portion of stock between the blank and draw punch 104 and the draw-redraw die 106 at the tooling station 102, as shown in the cup forming position in FIG. 8A and FIG. 8B. As shown in FIG. 8B, the cup is formed having a height H between the blank and draw punch 104 and the draw-redraw die 106. The cup is formed by drawing the portion of stock across tangent points of the varied radius of curvature of the blank and draw punch curved edge 506. As described above, by varying the radius of curvature of the blank and draw punch curved edge 506, the variance of a cup height H may be controlled (e.g., more uniform distribution), thereby using less metal to form the cup 802.

The method further includes moving the blank and draw punch and the draw-redraw die from the cup forming position to a can forming position shown at FIG. 9A and FIG. 9B and forming the can 902 and the flange 904 from the cup 802 by redrawing the formed cup 802 across tangent points of the varied radius of curvature of the draw-redraw die curved edge 606. As shown in FIG. 9B, the flange includes a flange width W. As described above, by varying the radius of curvature of the draw-redraw die curved edge 606, the variance of a flange width W around the outer circumference of the flange may be controlled (e.g., more uniform distribution), thereby using less metal to form the cup 802 and the can 902. Further, varying the radius of curvature of the blank and draw punch curved edge 506 may also contribute to controlling (e.g., more uniform distribution) variance of a flange width W. That is, a more uniform cup height H may help to control a more uniform flange width W when the flange 904 is formed.

The method described above includes forming the cup 802 and the can 902 having a flange 904 in the same tooling station 102. Other embodiments provide a method of forming the cup 802 and the can 902 in separate steps and in different tooling stations. Other embodiments provide a method of forming a plurality of cups 802 and cans 902 at a die assembly having multiple tooling stations. In these embodiments, each tooling station may include a blank and draw punch and a draw-redraw die. The cups and cans may be formed simultaneously in the multiple tooling stations.

Figure 11B:
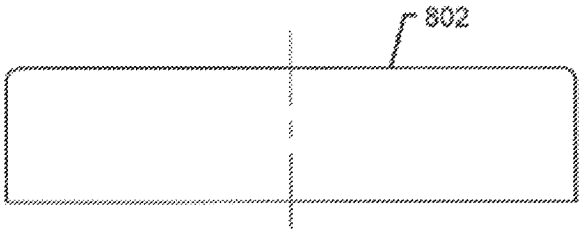
FIG. 11B is a side view of the formed cup shown in FIG. 8A and the close-up view in FIG. 8B.
Figure 11D:
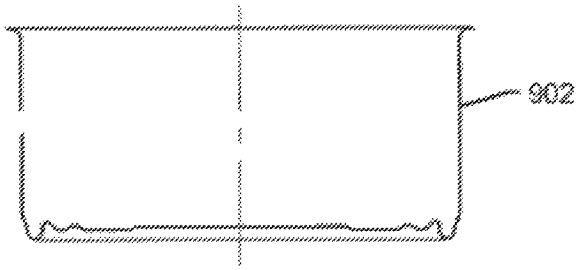
FIG. 11D is a side view of the formed can with an exemplary trimmed flange.
Figure 11A:
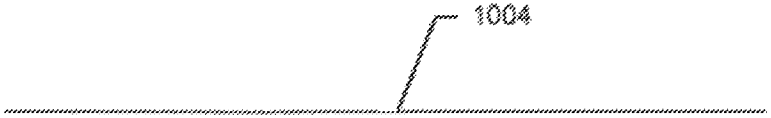
FIG. 11A is a side view of a portion of metal prior to being formed into a cup as shown in FIG. 7A and the close-up view in FIG. 7B.
Figure 11C:
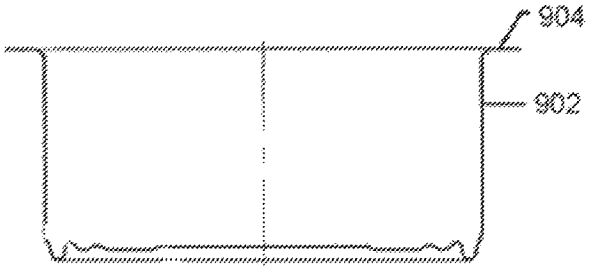
FIG. 11C is a side view of the formed can having the untrimmed flange shown in FIG. 9A and the close-up view in FIG. 9B.

FIG. 11 A through FIG. 11D show the metal at different states of the cup forming and can forming process. FIG. 11A is a side view of a portion of metal 1004 prior to being formed into a cup. FIG. 11B is a side view of the formed cup 802 shown in FIG. 8A and the close-up view in FIG. 8B. FIG. 11C is a side view of the formed can 902 having the untrimmed flange 904 shown in FIG. 9A and the close-up view in FIG. 9B. FIG. 11D is a side view of the formed can 902 with the flange having been trimmed.

Figure 12A:
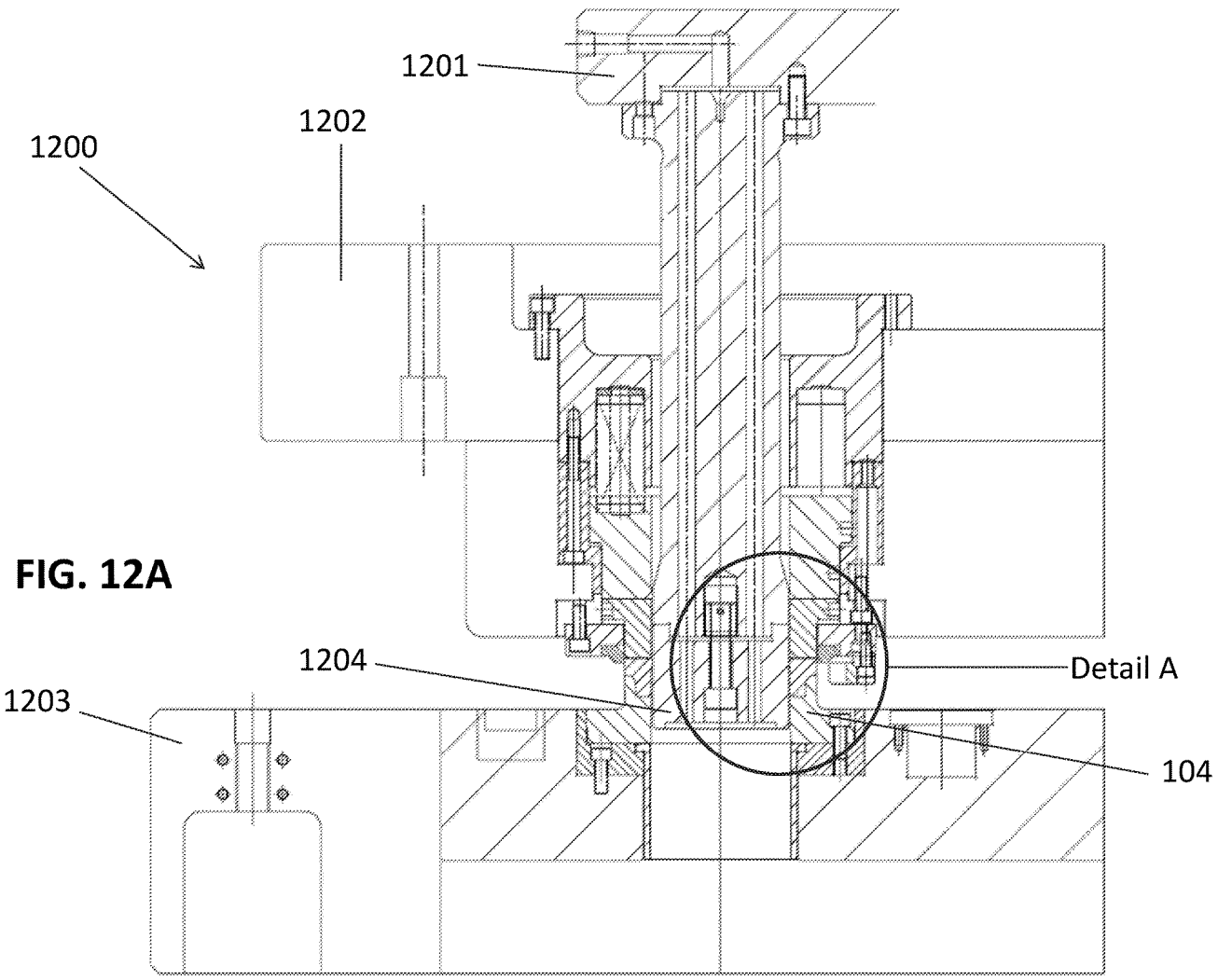
FIG. 12A is a cross sectional view of the exemplary die assembly as embodied in a double action draw press.

FIG. 12A is a cross sectional view of the exemplary die assembly as embodied in a double action draw press 1200. The double action draw press 1200 can have two rams, otherwise referred to as an inner slide 1201 and an outer slide 1202. The inner slide 1201 and outer slide 1202 can move in a reciprocal manner in regards to a fixed base 1203 in order to form two-piece containers from stock. The inner slide 1201 and outer slide 1202 each has a different stroke length, with the strokes being offset at a phase angle. In an embodiment, the outer slide 1202 can have a shorter stroke, and by combining with a pneumatic or spring pressure system, can hit the stock first with the blank and draw punch 104 to create a blank and apply the required draw pressure. The inner slide 1201 can include a draw punch 1204 that can move independently of the outer slide 1202. In an embodiment, the inner slide 1201 can have a longer stroke than the outer slide 1202. After the outer slide 1202 has created the blank of material, the inner slide 1201 can travel in a downward motion to form the cup or can by pulling the blank across the tangent points of the variable radius on the blank and draw punch 104.

The double action press 1200 can allow for better control of the drawing process by allowing a user to maintain a more consistent pressure throughout the entire draw process. The more accurate control of the draw pressure at the conclusion of the draw process can prevent pinching of the material while greatly reducing or eliminating stray slivers, as well as reducing haring of the material at the top edge of the container. A double action press system 1200 can allow for less tonnage per slide, while allowing for shorter strokes and faster operating speeds.

Figure 12B:
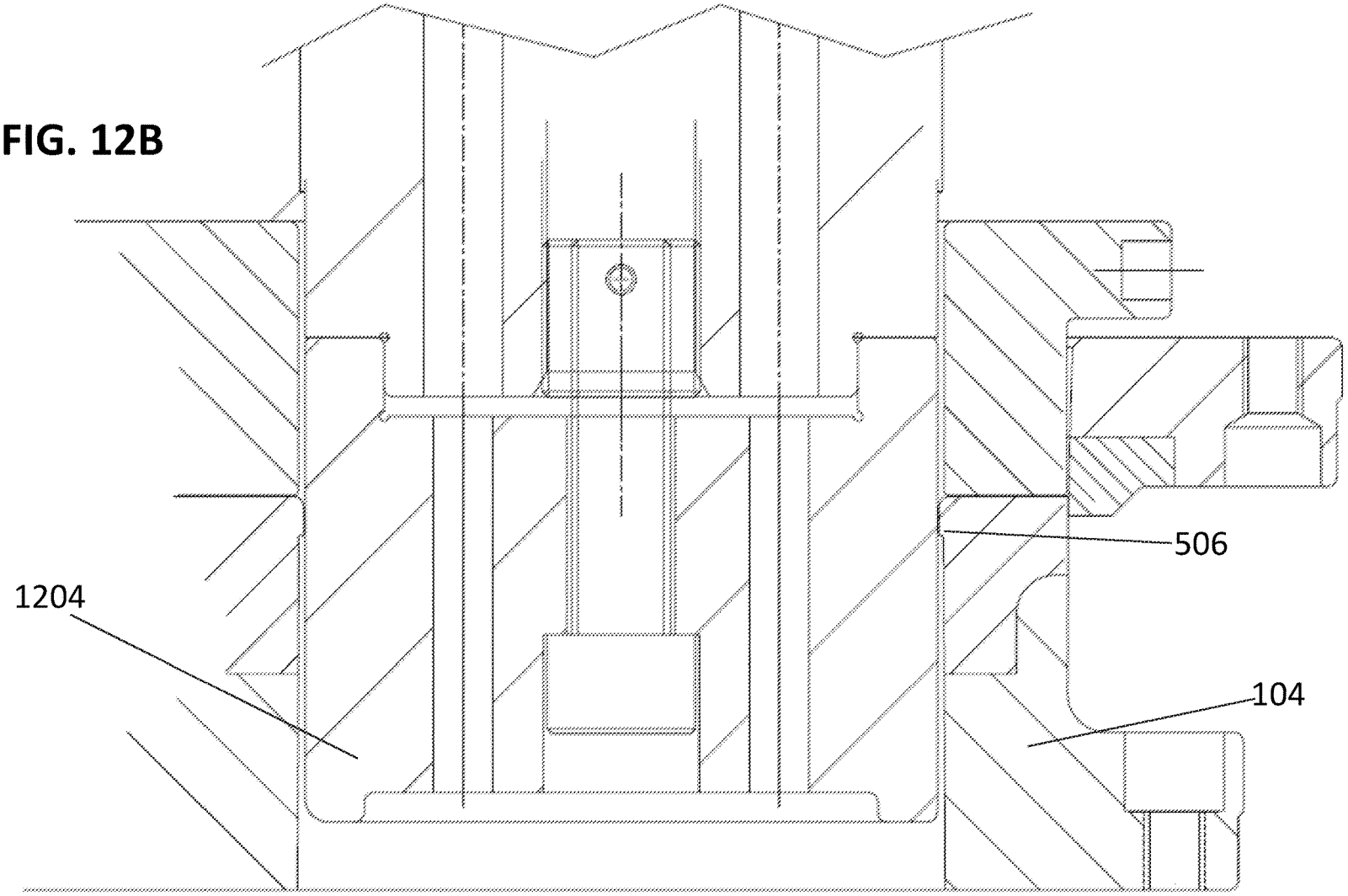
FIG. 12B is a close-up view of detail A of the exemplary die assembly shown in FIG. 12A illustrating an exemplary die assembly as embodied in a double action draw press.

FIG. 12B is a close-up view of detail A of the exemplary die assembly shown in FIG. 12A illustrating an exemplary die assembly as embodied in a double action draw press 1200. Similar to previous embodiments, the blank and draw punch 104 located at the boundary between the inner slide 1201 and the outer slide 1202 can have a blank and draw punch curved edge 506 with one or more variable radii, as described in FIG. 5E. The blank and draw punch 104 can be mounted on the outer slide. Additionally, the punch center 1204 of the inner slide 1201 can also have one or more variable radii around the circumference of the punch center 1204, similar to the varying radii of the blank and draw punch 104 and the draw-redraw die (not show) as described in FIG. 5E and FIG. 6E, respectively. An alternate embodiment can provide a double action press 1200 having a punch center 1204 with a varying radius and a blank and draw punch 104 with a consistent radius. An alternate embodiment can provide a double action press 1200 having a punch center 1204 with a consistent radius and a blank and draw punch 104 having a variable radius.

FIG. 13 is a table showing test run results generated by using an exemplary die assembly as shown in FIG. 1 through FIG. 4. Cans produced using the exemplary die assembly had a significantly lower standard deviation on the flange width than the sample produced using a conventional die having a continuous radius. Standard deviation for the maximum flange width using a conventional die 1301 was 0.0129 inches. Standard deviation for the minimum flange width using a conventional die 1302 was 0.0206 inches. In contrast, standard deviation for the maximum flange width using the exemplary die 1303 was 0.0023 inches, while the standard deviation for the minimum flange width using the exemplary die 1304 was 0.0017 inches. The order of magnitude reduction in the standard deviations can result in downstream equipment being provided with more consistently created parts, which can result in easier setup, less downtime, and more finely tuned tolerances for all machines due to the reduction in incoming part dimension variances.

The system and processes of the figures are not exclusive. Other systems, processes and menus may be derived in accordance with the principles of embodiments described herein to accomplish the same objectives. It is to be understood that the embodiments and variations shown and described herein are for illustration purposes only. Modifications to the current design may be implemented by those skilled in the art, without departing from the scope of the embodiments. As described herein, the various systems, subsystems, agents, managers and processes can be implemented using hardware components, software components, and/or combinations thereof. No claim element herein is to be construed under the provisions of 35 U.S.C. 112, sixth paragraph, unless the element is expressly recited using the phrase "means for."

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A tooling station for forming containers, comprising:

(i) a blank and draw punch configured to blank off a round portion of stock from a stock element and draw the round portion of stock to form a cup, the blank and draw punch comprising:

a blank and draw punch inner circumferential wall defining a blank and draw punch cavity;

a blank and draw punch proximal surface extending substantially perpendicular to the blank and draw punch inner circumferential wall; and a blank and draw punch curved edge disposed between the blank and draw punch inner circumferential wall and the blank and draw punch proximal surface, the blank and draw punch curved edge having-a radius of curvature that varies along its circumference such that cross-sectional profiles of the blank and draw punch curved edge are different at different circumferentially-spaced locations; and (ii) a draw-redraw die configured to redraw the cup to form a can having a flange, the draw-redraw die comprising:

a draw-redraw die inner circumferential wall defining a draw-redraw die cavity;

a draw-redraw die proximal surface extending substantially perpendicular to the draw-redraw die inner circumferential wall; and a draw-redraw die curved edge disposed between the draw-redraw die inner circumferential wall and the draw-redraw die proximal surface, the draw-redraw die curved edge having a radius of curvature that varies along its circumference such that cross-sectional profiles of the draw-redraw die curved edge are different at different circumferentially-spaced locations.

2. The tooling station according to claim 1, wherein the blank and draw punch is configured to form the cup by drawing the round portion of stock across tangent points of the varied radius of curvature of the blank and draw punch curved edge.

3. The tooling station according to claim 2, wherein the draw-redraw die is configured to form the can having the flange by redrawing the formed cup across tangent points of the varied radius of curvature of the draw-redraw die curved edge.

4. The tooling station according to claim 3, wherein the varied radius of curvature of the blank and draw punch curved edge is further configured to control a variance of a height of a top edge of the cup; and the varied radius of curvature of the draw-redraw die curved edge is further configured to control a variance of a flange width or cup height.

5. A blank and draw punch for forming cups, the blank and draw punch comprising:

a blank and draw punch base; and a blank and draw punch cylindrical portion extending from the blank and draw punch base, the blank and draw punch cylindrical portion comprising:

a blank and draw punch inner circumferential wall defining a blank and draw punch cavity;

a blank and draw punch proximal surface extending substantially perpendicular to the blank and draw punch inner circumferential wall; and a blank and draw punch curved edge disposed between the blank and draw punch inner circumferential wall and the blank and draw punch proximal surface, the blank and draw punch curved edge having a radius of curvature that varies along its circumference such that cross-sectional profiles of the blank and draw punch curved edge are different at different circumferentially-spaced locations wherein the blank and draw punch is configured to blank off a round portion of stock from a stock element and draw the round portion of stock across tangent points of the varied radius of curvature of the blank and draw punch curved edge.

6. The blank and draw punch according to claim 5, wherein the varied radius of curvature of the blank and draw punch curved edge is further configured to control a variance of a height of a top edge of a cup formed by the blank and draw punch.

7. A die assembly for forming containers, the die assembly having a plurality of tooling stations, each tooling station comprising:

(i) a blank and draw punch configured to blank off a round portion of stock from a stock element and draw the round portion of stock to form a cup, the blank and draw punch comprising:

a blank and draw punch inner circumferential wall defining a blank and draw punch cavity;

a blank and draw punch proximal surface extending substantially perpendicular to the blank and draw punch inner circumferential wall; and a blank and draw punch curved edge disposed between the blank and draw punch inner circumferential wall and the blank and draw punch proximal surface, the blank and draw punch curved edge having a radius of curvature that varies along its circumference such that cross-sectional profiles of the blank and draw punch curved edge are different at different circumferentially-spaced locations; and (ii) a draw-redraw die configured to redraw the cup to form a can having a flange, the draw-redraw die comprising:

a draw-redraw die inner circumferential wall defining a draw-redraw die cavity;

a draw-redraw die proximal surface extending substantially perpendicular to the draw-redraw die inner circumferential wall; and a draw-redraw die curved edge disposed between the draw redraw die inner circumferential wall and the draw-redraw die proximal surface, the draw-redraw die curved edge having a radius of curvature that varies along its circumference such that cross-sectional profiles of the draw-redraw die curved edge are different at different circumferentially-spaced locations.

8. A method of forming containers comprising:

receiving a stock element at a tooling station having a blank and draw punch comprising a blank and draw punch curved edge disposed between a blank and draw punch inner circumferential wall and a blank and draw punch proximal surface, the blank and draw punch curved edge having a radius of curvature that varies along its circumference such that cross-sectional profiles of the blank and draw punch curved edge are different at different circumferentially-spaced locations;

blanking off a round portion of stock from the stock element using the blank and draw punch; and forming, via the blank and draw punch, a cup from the round portion of stock by drawing the portion of stock across tangent points of the varied radius of curvature of the blank and draw punch curved edge.

9. The method of forming containers according to claim 8, wherein forming the cup from the round portion of stock further comprises controlling a variance of a height of a top edge of the cup.

10. The method of forming containers according to claim 8, further comprising:

receiving the cup at another tooling station spaced from the first tooling station, the other tooling station having a draw-redraw die comprising a draw-redraw die curved edge disposed between a draw-redraw die inner circumferential wall and a draw-redraw die proximal surface, the draw-redraw die curved edge having a radius of curvature that varies along its circumference such that cross-sectional profiles of the draw-redraw die curved edge are different at different circumferentially-spaced locations; and forming, via the draw-redraw die, a can having a flange from the cup by redrawing the formed cup across tangent points of the varied radius of curvature of the draw-redraw die curved edge.

11. The method of forming containers according to claim 10, wherein forming the can having the flange further comprises controlling a variance of a flange width around an outer circumference of the flange.

* * * * *